US008716586B2

(12) United States Patent
Thuillier

(10) Patent No.: US 8,716,586 B2
(45) Date of Patent: May 6, 2014

(54) PROCESS AND DEVICE FOR SYNTHESIS OF AN AUDIO SIGNAL ACCORDING TO THE PLAYING OF AN INSTRUMENTALIST THAT IS CARRIED OUT ON A VIBRATING BODY

(76) Inventor: Etienne Edmond Jacques Thuillier, Strasbourg (FR)

( * ) Notice: Subject to any disclaimer, the term of this patent is extended or adjusted under 35 U.S.C. 154(b) by 8 days.

(21) Appl. No.: 13/079,037

(22) Filed: Apr. 4, 2011

(65) Prior Publication Data

US 2011/0290098 A1 Dec. 1, 2011

Related U.S. Application Data

(60) Provisional application No. 61/320,932, filed on Apr. 5, 2010, provisional application No. 61/320,964, filed on Apr. 5, 2010.

(51) Int. Cl.
*G10H 1/06* (2006.01)

(52) U.S. Cl.
USPC ..... 84/735; 84/723; 84/726; 84/731; 84/737

(58) Field of Classification Search
None
See application file for complete search history.

(56) References Cited

U.S. PATENT DOCUMENTS

| | | | | |
|---|---|---|---|---|
| 5,218,160 | A | 6/1993 | Grob-Da Veiga | |
| 5,418,858 | A * | 5/1995 | Shoureshi | 381/71.2 |
| 5,569,870 | A | 10/1996 | Hirano | |
| 5,969,282 | A | 10/1999 | Berners | |
| 5,973,253 | A * | 10/1999 | Hirata | 84/609 |
| 7,786,370 | B2 * | 8/2010 | Ludwig | 84/645 |

(Continued)

FOREIGN PATENT DOCUMENTS

EP 0454047 10/1991

OTHER PUBLICATIONS

Laurson M. and AL, Methods for modeling realistic playing in acoustic guitar synthesis, Computer Music Journal, Sep. 2001 (2001-2009), pp. 38-49, vol. 25 No. 3, MIT Press, USA.

(Continued)

*Primary Examiner* — Marlon Fletcher

(57) ABSTRACT

Process for synthesis of a synthesized audio signal, in which at least one audio signal of contact is produced for each excitation contact of a sequence of contacts carried out on a vibrating body (2). A partial attenuation signal of remanence is generated from at least one vibration signal representative of the vibration of the vibrating body (2) generated by at least one excitation contact, named partial contact, the partial attenuation signal of remanence being representative, of a partial attenuation of at least one remanent audio signal of contact, resulting from an excitation contact that is previous to said partial contact. The synthesized audio signal after said partial contact is produced by mixing the audio signal of contact of said partial contact and each remanent audio signal of contact affected by the partial attenuation signal of remanence. The invention extends to a device (3) for synthesizing said synthesized audio signal. The invention relates in addition, to a process and a device (3) for synthesis from a signal, named transposition signal, resulting from a sequence of contacts of changes in pitch of the vibrating body's (2) vibration. For at least one excitation contact of change in pitch, at least one frequency component, named channeled component, of an audio signal of contact, named tonal signal of contact, resulting from an excitation contact that is previous to said excitation contact of change in pitch, is modulated around a harmonic frequency of a new pitch, corresponding to a harmonic rank different from the harmonic rank of a preceding synthesis frequency of the channeled component.

17 Claims, 14 Drawing Sheets

(56) References Cited

U.S. PATENT DOCUMENTS

Figure 1:
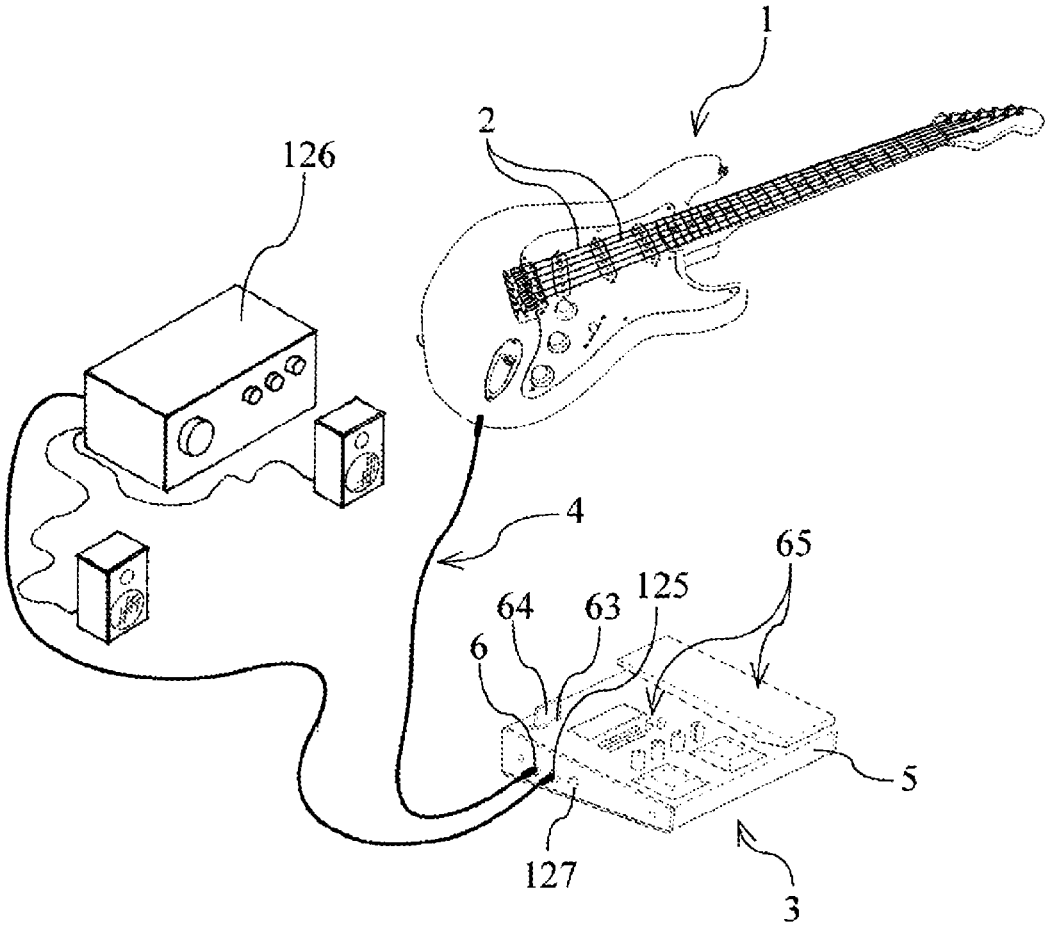

| | | | | |
|---|---|---|---|---|
| 8,030,566 | B2 * | 10/2011 | Ludwig | 84/622 |
| 8,269,095 | B1 * | 9/2012 | Wallace | 84/726 |
| 8,581,086 | B2 * | 11/2013 | McMillen et al. | 84/645 |
| 2002/0198690 | A1 * | 12/2002 | Holzrichter et al. | 702/195 |
| 2003/0220556 | A1 * | 11/2003 | Porat et al. | 600/407 |
| 2003/0221542 | A1 | 12/2003 | Kenmochi | |
| 2005/0065426 | A1 * | 3/2005 | Porat et al. | 600/407 |
| 2007/0227344 | A1 * | 10/2007 | Ryle et al. | 84/723 |
| 2008/0004861 | A1 * | 1/2008 | Holzrichter et al. | 704/2 |

OTHER PUBLICATIONS

Karjalainen M. and AL, A model for real-time sound synthesis of guitar on a floating-point signal processor, ICASSP conference May 14-17, 1991, Apr. 14, 1991, pp. 3653-3656, vol. conf. 16, IEEE, New-York.

Huovilainen A. and AL, Virtual Air Guitar, 117th Audio Engineering Society Convention, Oct. 28-31, 2004, AES, USA.

Marentakis G. and AL, Sinusoidal Synthesis Optimization, International computer music conference, Jan. 1, 2002, pp. 1-4.

Lecointe M., Private communication of foreign office to applicant (english translation provided) : Preliminary search report and written opinion for a french patent app. (#FR1001155) that is identical to prov. U.S. Appl. No. 61/320,932, transmittal by foreign office on Oct. 1, 2010.

* cited by examiner

PROCESS AND DEVICE FOR SYNTHESIS OF AN AUDIO SIGNAL ACCORDING TO THE PLAYING OF AN INSTRUMENTALIST THAT IS CARRIED OUT ON A VIBRATING BODY

This application claims benefit of provisional patent application Ser. No. 61/320,932 filed 2010 Apr. 5th by the present inventor.

This application claims benefit of provisional patent application Ser. No. 61/320,964 filed 2010 Apr. 5th by the present inventor.

A first aspect of the invention relates to a process and a device for synthesis of an audio signal, named synthesized audio signal, from a sequencing signal representative of a sequence of contacts carried out on a vibrating body, said sequence comprising excitation contacts suitable for bringing the vibrating body into vibration, process in which at least one audio signal, named audio signal of contact, is produced for each of said excitation contacts. A second aspect of the invention relates to such a process for synthesis and such a device for synthesis of an audio signal from, in addition, a signal, named transposition signal, resulting from a sequence of contacts of changes in pitch of the vibrating body's vibration carried out on the vibrating body, the transposition signal being representative, for each contact of change in pitch, of at least one harmonic frequency corresponding to a pitch resulting from the contact of change in pitch, process and device in which several frequency components, named modulated components, of at least one audio signal of contact, named tonal signal of contact, are each modulated successively around harmonic frequencies, named synthesis frequencies, each specific to a harmonic rank of a pitch of the sequence of contacts of changes in pitch.

The musical instrument digital interface protocol, named MIDI protocol, allows for presenting the playing of an instrumentalist in the form of a sequence of events in time, each described according to a number of predetermined descriptors (time of a sound triggering, pitch of a note, intensity . . . ). This protocol is particularly suited for describing the playing of a keyboard player and has been used to this end to a large extent.

Some known apparatus, named traditional MIDI converters, are adapted for carrying out an audio to MIDI conversion, with a view to allow for controlling a MIDI compatible synthesizer with a musical instrument equipped with vibrating bodies (for example, the strings of a guitar) entering into free vibration following the execution of excitation contacts carried out on the vibrating body. Those apparatus comprises linking means with at least one microphone mounted on the musical instrument, said microphone providing for each vibrating body, a signal, named microphone signal, representative of the vibration of the vibrating body.

Traditional MIDI converters produce MIDI messages for the control of a MIDI compatible synthesizer from the microphone signal. To this end, traditional MIDI converters are adapted for detecting at any given moment if the microphone signal conforms to detection criterions predefined for excitation contacts carried out on the vibrating body, triggering on that ground a synthesized sound. In addition, the traditional MIDI converters are adapted for detecting at any given moment during the free vibration of the vibrating body, if the microphone signal conforms to detection criterions predefined for complete-choking contacts carried out on the vibrating body by the instrumentalist, triggering on that ground an interruption of the ongoing synthesized sound. If the occasion arises, an interruption of the ongoing synthesized sound is in addition ordered following a newly detected excitation contact succeeding directly, without detection of a complete-choking contact beforehand, a preceding detected excitation contact.

As an example, we known traditional MIDI converters that carry out a detection of excitation contacts, named onset detection, in which a detected value of global variation of the vibration intensity of the vibrating body is compared to a predetermined amplification threshold of the vibration intensity, named onset detection threshold, beyond which is produced a new synthesized sound.

There is a need for optimizing the sensitivity of the detection of excitation contacts without it compromising the faithfulness of the representation of the instrumentalist's playing formed by the synthesized sounds.

A faithful translation of the instrumentalist's playing at the output of the compatible MIDI synthesizer is obtained only when the instrumentalist executes excitation contacts according to an appropriate note-on attack technique of the musical instrument given the onset detection criterions of the traditional MIDI converter.

Successively plucking a guitar string allows, for example, to produce with a traditional MIDI converter for guitar and a compatible MIDI synthesizer, a sequence of synthesized notes representative of the plucking sequence that is carried out. However, each plucking has to be neatly and distinctively executed at the risk that some plucks lack an audible consequence at the output of the MIDI compatible synthesizer.

An adjustment of the onset detection threshold has to be operated in order to improve the traditional MIDI converter's onset detection sensitivity so that excitation contacts carried out on the vibrating body causing a relatively low global amplification of the vibratory intensity are taken into account.

Such an adjustment implies however a higher risk of untimely detection of an excitation contact while the instrumentalist is not touching the vibrating body. Indeed, an exceeding of the onset detection threshold is at risk under the effect of non stationary vibratory components during the free vibration of the vibrating body (no contact with the vibrating body): beatings phenomenon of the string vibration, light excitation of the vibrating body by sympathetic vibration, light excitation of the vibrating body under absorption of a sound wave propagating in the air or transmitted in the vibrating body at fastening points of the vibrating body on the musical instrument . . . . The corresponding untimely synthesized sound is all the more inopportune that it interrupts unexpectedly a possible preceding synthesized sound whose production is ongoing.

In addition, actual detection of excitation contacts executed with attack techniques other than plucking of the string, in particular ornamentation techniques (rhythmic ornamentations, rubbings carried out on the string . . . ), is uncertain. In any case, the specifications of the MIDI protocol doesn't provide for translating the playing nuances corresponding to the aforementioned ornamentation techniques, the nuances corresponding to various attack techniques of the string (strike, plucking with a rest stroke also named apoyando, plucking with a free stroke also named tirando, plucking with a plectrum . . . ), the nuances corresponding to the different places on the string where said ornamentation and attack techniques are executed. In particular, the execution of ornamentation techniques is likely to cause production of synthesized sounds often untimely from the instrumentalist's point of view, in any case with very poor realism, which means in no way representative of the sound anticipated by the instrumentalist given the manipulation carried out on the string, thus eminently inappropriate.

In addition, some traditional MIDI converters carry out a detection of the pitch of vibration of the vibrating body from the microphone signal with view to produce a sequence of synthesized sounds translating the melodic phrasing carried out on the vibrating body by the instrumentalist. Such detection is advantageously carried out for instruments whose pitch is determined by direct manipulation of the vibrating body (a guitar string for example), without help from a mechanical assembly intervening between the instrumentalist and the vibrating body. Indeed, a synthesis representative of pitch changes and of the modulations of each played pitch is hence carried out with minimal cluttering of the musical instrument. As an example, in the case of the guitar, said pitch changes can be carried out by left hand playing techniques and said pitch modulations can be carried out by lateral traction of the string.

Now, any contact carried out on the vibrating body introducing inharmonic vibratory components and/or modifying the relative amplitudes of the harmonic vibratory components of the vibrating body, is likely to cause an unexpected change of the detected pitch although the instrumentalist hasn't made any voluntary gesture for such a modification. As an example, a contact of the vibrating body in free vibration at the level of a vibration node of a low frequency vibration mode, for example by the impact of a finger at this place, is likely to cause an inopportune change of the detected pitch for the remaining time of the vibration of the string in the absence of an additional detected contact. In addition, the transitory vibration components introduced by any contact, brief or extended, carried out on the string are likely to cause inopportune temporary changes of the detected pitch. An unexpected change of the detected pitch is all the more inopportune that it happens in the course of production of a previously triggered synthesized sound and that the later is not interrupted by the contact that caused the unexpected change. Indeed, the unexpected change causes in that case an unexpected pitch change effect in said synthesized sound, or a sound effect, named sudden tonal distortion effect, of temporary but sudden and disgraceful variation of the synthesized sound's timbre. It results, in one case or the other, in a deterioration of the faithfulness of the representation of the instrumentalist's playing, formed by the synthesized sounds.

Given the above, the instrumentalist is forced to strip his playing from any excitation contact not adapted to the predefined onset detection criterions, in particular from contacts likely to cause an unexpected change of the detected pitch, in order to allow complete control over the synthesis. It results in a reduction of the expressive potential of the musical instrument. In order to take full measure of the extent of musical discourse's alteration, one can for example imagine what would become of any musical piece for guitar after it being strip of the aforementioned effects: a succession of triggered sounds varying in intensity and duration, but who all have the same timbre. Therefore, the synthesizers controlled by traditional MIDI converters inherit the mechanical-like and disembodied quality of low-end electronic keyboards.

There is thus a need to produce, for any excitation contact carried out on the vibrating body, synthesized sounds representing faithfully and with realism said excitation contact, without limits as for the playing technique that is employed. In addition to the guitar which is given as an example, this problem is felt more generally for the musical instruments that are unequipped of a mechanical assembly intervening between the vibrating body and the instrumentalist with the result that a great amount of execution latitude is provided to the instrumentalist for exciting the vibrating body. The playing possibilities are then no more countable, the instrumentalist being able to freely choose the manipulations to carry out, the objects with which the manipulations are carried out if such case applies . . . .

The invention aims to palliate these drawbacks.

In particular, the invention aims to allow taking account of a greater number of excitation contacts carried out on the vibrating body, without compromising the faithfulness of the representation of the instrumentalist's playing formed by the synthesized sounds.

In particular, the invention aims to carry out this translation in a more representative way for each of said excitation contacts that is carried out, by taking account of the nuances with which attack techniques and ornamentation techniques can be carried out on the vibrating body.

In addition, the invention aims to allow for the execution of traditional instrumental techniques of the musical instrument without it causing a sudden tonal distortion effect or an unexpected pitch change effect of the synthesized sound, in any case with a diminishing of such unexpected effects. Also, the invention aims to allow translating pitch changes actually carried out by the instrumentalist with an improved degree of realism. In particular, the invention also aims to avoid any aggravation of a lag of the ongoing pitch's detection.

The invention aims in addition to supply such a solution that can be carried out under a cheap cost price, notably that can be carried out on an electronic and/or data-processing device constituted of cheap costing components, in particular generic computer and/or electronic components of the market.

The invention also aims to offer a device and a process for synthesis of an audio signal from a sequencing signal representative of a sequence of contacts carried out on a vibrating body and suitable for bringing the vibrating body into vibration, that is compatible with a real time implementation free of any crippling lag between a contact carried out on the vibrating body and its effect in the synthesized audio signal.

The invention also aims to reach these goals in a manner which is technically simple to develop, notably for several categories of musical instruments without significant additional cost for its adaptation for various instrument categories, for example the guitar with solid of hollow body, with metal or nylon strings, the bass guitar, the banjo, the mandolin, the violin, the cello, the upright bass, the alto etc.

To this end, a first aspect of the invention relates to a process for synthesis of an audio signal, named synthesized audio signal, from a sequencing signal representative of a sequence of contacts carried out on a vibrating body, said sequence comprising excitation contacts suitable for bringing the vibrating body into vibration, process in which:

at least one audio signal, named audio signal of contact, is produced for each of said excitation contacts, a signal, named partial attenuation signal of remanence, is produced from a signal, named vibration signal, representative of the vibration of the vibrating body generated by at least one excitation contact, named partial contact, the partial attenuation signal of remanence being representative for said partial contact, of at least one partial attenuation value of remanence of at least one audio signal of contact, named remanent audio signal of contact, resulting from an excitation contact that is previous to said partial contact, the synthesized audio signal after said partial contact is produced by mixing the audio signal of contact of said partial contact and each remanent audio signal of contact affected by the partial attenuation signal of remanence.

In all this text, the term <<signal>> is used according to its functional acceptation with no limitation as to the employed mode of representation of the signal. In particular, one (or several) analog and/or digital transmission channel(s) (electrical, radiofrequency, optical . . . ) can be used for each signal of the invention. As an example, an audio frequency signal can be transmitted by means of several analog transmission channels each dedicated to the transmission of an audio frequency sub-band of the signal. In addition, each signal can originate from one or several sources. As an example, the vibration signal of the invention can originate from one or several microphone circuits sensing the vibration of the vibrating body.

The invention finds an advantageous application for musical instruments allowing for executing excitation contacts without completely interrupting the vibration of the vibration body that is ongoing at the beginning of the excitation contact. Such is notably the case of musical instruments unequipped with a mechanical assembly intervening between the vibrating body and the instrumentalist, in particular plucked string musical instruments (each string serving as a vibrating body). These musical instruments allow indeed for executing excitation contacts that are more or less complex, in particular contacts that produce all at once amplification of vibration intensity and partial or total attenuation of vibration intensity in different frequency bands. Hence, the invention allows producing a synthesized audio signal that takes account of a partial attenuation signal of remanence representative of a partial attenuation effect of the vibrating body's vibration that is ongoing at the beginning of the partial contact. This effect can be translated in response to the partial contact by attenuating audio signals of contacts that are ongoing at the time of the partial contact, accordingly to the partial attenuation signal of remanence.

Furthermore, in a process according to the invention, the remanent audio signal of contact is not interrupted in an untimely fashion in response to the detection of such a partial contact. In particular, it is possible to carry out a detection of excitation contacts based on criterions that are less selective than that in the prior methods so that a greater number of excitation contacts carried out on the vibrating body are followed by a corresponding audio signal of contact, with the benefit of a greater faithfulness of the instrumentalist's playing representation produced by the synthesis. The invention allows for example to implement an onset detection with a lowered onset detection threshold, and even to be freed from the necessity of using an onset detection threshold.

The invention distinguishes itself in particular from processes of synthesis from a sequencing signal resulting from the programming of an electronic musical score or from MIDI keyboard command. Indeed, in the invention the sequencing signal results from a sequence, really carried out on the vibrating body, of contacts really carried out on the vibrating body. The invention allows therefore translating a rhythmic phrasing really carried out by an instrumentalist on a real vibrating body. In particular, the sequencing signal is generated by a sequence of contacts carried out on the vibrating body by an instrumentalist. This sequencing signal and the partial attenuation signal of remanence can be produced in real time as the vibration of the vibrating body takes place, from at least one microphone signal resulting from the vibration of the vibrating body under the effect of contacts carried out on this vibrating body. The microphone signal is hence representative of the vibration of the vibrating body sensed by a microphone sensor. In this respect, the process can further comprise a reception step, named input step, of said microphone signal. In particular, the sequencing signal can be extracted from said microphone signal during a transient detection step, in which a transient of the microphone signal is extracted for each excitation contact.

Advantageously and according to the invention, the sequencing signal is representative of a detected sequence of contacts carried out on the vibrating body by an instrumentalist. In particular, during a detection step of the process, a sequence of contacts carried out on the vibrating body by an instrumentalist is detected.

Advantageously and according to the invention, the sequencing signal is produced from a signal, named source signal for excitation detecting, representative of the vibration of the vibrating body under the effect of the excitation contacts, as the reception of the source signal for excitation detecting takes place.

In particular, the sequencing signal can be produced by iterative execution of a detection step of excitation contacts, executed from the source signal for excitation detecting. In particular, said vibration signal used for producing said partial attenuation signal of remanence can be formed by said source signal for excitation detecting.

Advantageously and according to the invention:

- data, named partial attenuation data of remanence, is produced for at least one partial contact, from the vibration signal, the partial attenuation data of remanence data being representative of at least one partial attenuation value of remanence of at least one remanent audio signal of contact resulting from an excitation contact that is previous to said partial contact,
- the synthesized audio signal after said partial contact is produced by mixing the audio signal of contact of said partial contact and each remanent audio signal of contact affected by the partial attenuation signal of remanence.

Advantageously and according to the invention, said partial attenuation value of remanence is determined from values of said vibration signal belonging to a time interval, named interval for detecting remanence attenuation, during which said partial contact is carried out on the vibrating body.

More particularly, advantageously and according to the invention:

- the sequencing signal comprises for each excitation contact, contact data produced from values of the source signal for excitation detecting, belonging to a time interval, named excitation contact interval, during which the excitation contact is carried out on the vibrating body,
- said partial attenuation value of remanence is determined from values of said vibration signal, belonging to a time interval, named remanence attenuation's detection interval, presenting a upper boundary concomitant or subsequent to the upper boundary of the excitation contact interval corresponding to the partial contact.

Advantageously an according to the invention, said partial attenuation value of remanence is determined by comparing between:

- at least one value, named real value, extracted from the vibration signal on a first time interval of the vibration signal,
- and at least one value, named prediction value, determined from:
  - at least one second value extracted from the vibration signal on a second time interval of the vibration signal, that is previous to the first time interval,
  - and according to a predetermined prediction model of the variation in time of the vibration signal between the first and the second time interval.

More particularly, advantageously and according to the invention, said partial attenuation value of remanence is determined by comparing between several real values extracted from said first time interval, and several prediction values determined from several values extracted from the vibration signal on said second time interval. In particular, advantageously and according to the invention, said partial attenuation value of remanence is determined by doing a projection between a first waveform, named real waveform, extracted on said first time interval, and a waveform, named predicted waveform, determined from a second waveform extracted from the vibration signal on said second time interval.

Advantageously and according to the invention, the partial attenuation signal of remanence is in addition produced from prerecorded damping data, representative of the damping in free vibration of at least one frequency component of the vibration signal.

Thus, the invention allows to determine attenuation values (notably partial attenuation values of remanence, partial attenuation values of muffling, complete attenuation values and nil attenuation values, as defined hereinafter) for several successive intervals of the vibration signal, including during free vibration, without compromising the possibility to reproduce faithfully, in the absence of contacts with the vibrating body, the characteristic evolution of the frequency components amplitudes of a sound source whose timbre is to be simulated, for example a prerecorded piano sound from which the audio contact signals are generated. The invention allows then to carry out an attenuation detecting that is particularly sensitive, taking account of subtle contacts causing only a slight attenuation of the vibrating body, such as carried out for example during the application of the hand's palm on the bridge so as to slightly enter in contact with the end of the vibrating string at bridge level (pizzicato).

Advantageously and according to the invention, the process comprises:

- a step for extracting a signal of intensity variation rate of the vibration signal, executed from the vibration signal,
- a step for producing a partial attenuation signal of remanence from the signal of intensity variation rate, in which the dynamic range of said signal of intensity variation rate is compressed according to a compressed dynamic range having a maximum value of compressed dynamic range smaller than or essentially equal to 0 decibels.

More particularly, advantageously and according to the invention, the signal of intensity variation rate is representative of an intensity variation rate of the vibration signal in various frequency bands. In particular the signal of intensity variation rate can be representative of the mean of intensity variation rate values specific to different frequency bands. Alternatively, the signal of intensity variation rate can be representative of several intensity variation rate values specific to the various frequency bands and a compression of the dynamic range of the signal of intensity variation rate can be carried out in each of the frequency bands. In addition, each intensity variation rate value can be determined according to a model of the vibrating body and of the vibration signal that is more or less complicated. As an example, each value of the signal of intensity variation rate can be representative of a global rate of amplitude variation of the frequency component held in the frequency band, without taking account for a possible drift of the frequency component's phase. Alternatively, each value of the signal of intensity variation rate can be preferably representative of a variation rate at constant phase according to a fixed reference in time, of the amplitude of said frequency component.

Advantageously and according to the invention, said partial attenuation value of remanence is detected for a frequency component of the vibration signal. In particular, said partial attenuation value of remanence can be equal to a detected value of said frequency component's intensity variation rate.

Advantageously and according to the invention, the partial attenuation signal of remanence is representative of several partial attenuation values of remanence of a selfsame remanent audio signal of contact, detected for different frequency components of the vibration signal. More particularly, advantageously and according to the invention, the remanent audio signal of contact has several frequency components, each affected by at least one partial attenuation value of remanence specific to an associated frequency component of the vibration signal. The invention allows therefore for a particularly faithful translation of the playing nuances of partial choking contacts and partial contacts, carried out with various playing techniques. In particular, the invention allows the translation of attenuation nuances corresponding to various places on the vibrating body where the contacts are carried out.

More particularly, advantageously and according to the invention, the partial attenuation signal of remanence is representative of several partial attenuation values of remanence of a selfsame remanent audio signal of contact, detected for various harmonic frequency components of the vibration signal. The invention allows therefore translating in a particularly realistic manner a contact of the vibrating body at the level of a vibration node of a low frequency mode.

Furthermore, a second aspect of the invention relates to a process for synthesis of an audio signal, named synthesized audio signal, from:

- a sequencing signal representative of a sequence of contacts carried out on a vibrating body, said sequence comprising excitation contacts suitable for bringing the vibrating body into vibration, and
- a signal, named transposition signal, resulting from a sequence of contacts of changes in pitch of the vibrating body's vibration carried out on the vibrating body, the transposition signal being representative, for each contact of change in pitch, of at least one harmonic frequency corresponding to a pitch resulting from the contact of change in pitch, process in which:
- at least one audio signal of contact is produced for each of said excitation contacts,
- several frequency components, named modulated components, of at least one audio signal of contact, named tonal signal of contact, are each modulated successively around harmonic frequencies, named synthesis frequencies, each specific to a harmonic rank of a pitch of the sequence of contacts of changes in pitch,
- for at least one excitation contact, named excitation contact of change in pitch, causing a change in pitch towards a new pitch, at least one modulated component, named channeled component, of a tonal signal of contact, named harmonized tonal signal, resulting from an excitation contact that is previous to said excitation contact of change in pitch, is modulated around a harmonic frequency, named new synthesis frequency, of the new pitch, corresponding to a harmonic rank different from the harmonic rank of a preceding synthesis frequency of the channeled component,
- the synthesized audio signal after said excitation contact of change in pitch is produced by mixing each harmonized tonal signal and the audio signal of contact of said excitation contact of change in pitch.

Hence, the excitation contact of change in pitch forms a contact of change in pitch of the sequence of contacts of changes in pitch.

Hence, the invention allows for producing in response to said excitation contact of change in pitch, a new tonal signal of contact bringing frequency contributions to the synthesized audio signal that are distributed according to the harmonic frequencies of the new pitch that is carried out, without need for interrupting any tonal signal of contact resulting from a excitation contact that is previous to the excitation contact of change in pitch. Indeed, the modulated components of a harmonized tonal signal according to the invention are, following the excitation contact of change in pitch, distributed in frequency in conformity with new pitch so that they combine themselves in a harmonious fashion with any tonal signal resulting from the excitation contact of change in pitch. This distribution can be obtained thanks to the invention by modulating in a moderate fashion each channeled component following said excitation contact of change in pitch. Hence, the invention allows for compensating at least partly an unexpected pitch change effect or a sudden tonal distortion effect in the harmonized tonal signal, that results from an unexpected change of the detected pitch by effect of the excitation contact of change in pitch on the vibrating body. In addition, the invention allows for translating pitch changes actually carried out by the instrumentalist with an increased realism, in particular the pitch changes corresponding to a finger impact, named harmonic contact, at the level of a vibration node of a low frequency vibration mode of the vibrating body, leading to an interruption of some harmonic vibration modes of the vibrating body.

Given the above, the second aspect of the invention allows for taking account of a greater number of excitation contacts carried out on the vibrating body, without compromising the faithfulness of the instrumentalist's playing representation formed by the synthesized sounds.

In this text, the expression <<harmonic frequency>> is, except contrary mention, used under its largest acceptation, designating frequencies who are not necessarily exact multiple integers of a corresponding fundamental frequency given possible phenomenons of inharmonicity. In addition, the fundamental frequency forms a harmonic frequency of rank 1 in this terminology.

Advantageously and according to the invention, the transposition signal is produced from a signal, named source signal for extracting harmonic frequency(ies) of vibration, representative of the vibration of the vibrating body. More particularly, advantageously and according to the invention, the transposition signal can be produced by extraction of harmonic frequency(ies) of vibration, for example a fundamental frequency of vibration, as the source signal for extracting harmonic frequency(ies) of vibration is received, in particular by means of iterative execution of an extraction step of one or several harmonic frequency(ies) of the source signal for extracting harmonic frequency(ies) of vibration.

In particular, the first and the second aspect of the invention combine themselves advantageously when the excitation contact of change in pitch is a partial contact. Hence, advantageously and according to the invention:

the synthesized audio signal is in addition produced from a signal, named transposition signal, resulting from a sequence of contacts of changes in pitch of the vibrating body's vibration carried out on the vibrating body, the transposition signal being representative, for each contact of change in pitch, of at least one harmonic frequency corresponding to a pitch resulting from the contact of change in pitch, in such way that several frequency components, named modulated components, of at least one audio signal of contact are each modulated successively around harmonic frequencies, named synthesis frequencies, each specific to a harmonic rank of a pitch of the sequence of contacts of changes in pitch, for at least one partial contact, named partial contact of change in pitch, causing a change in pitch towards a new pitch, at least one modulated component, named channeled component, of a corresponding remanent audio signal of contact, named harmonized remanent audio signal of contact, is modulated around a harmonic frequency, named new synthesis frequency, of the new pitch, corresponding to a harmonic rank different from the harmonic rank of a preceding synthesis frequency of the channeled component.

Hence, the partial contact of change in pitch forms a contact of change in pitch of the sequence of contacts of changes in pitch.

Advantageously and according to the first and second aspect of the invention, said frequency components of the vibration signal being held in different frequency bands of the vibration signal, the channeled component is attenuated according to at least one partial attenuation value of remanence of the partial attenuation signal of remanence, detected for a frequency component whose frequency band holds the new synthesis frequency of the channeled component.

Advantageously and according to the invention, the transposition signal is representative of a pitch sequence according to which the vibrating body is brought into vibration.

Advantageously and according to the invention, the new synthesis frequency is chosen in such way that it finds itself, amongst the harmonic frequencies of the new pitch, directly neighboring said preceding synthesis frequency. In particular, advantageously and according to the invention, the new synthesis frequency is chosen in such way that it finds itself, amongst the harmonic frequencies of the new pitch, the closest harmonic frequency of the new pitch to said preceding synthesis frequency, according preferably to a logarithmic scale of frequency.

More particularly, advantageously an according to the invention, several modulated components of the harmonized remanent audio signal of contact, named low rank components, whose synthesis frequencies, named preceding synthesis frequencies, in force for a pitch preceding the new pitch in the sequence, are inferior to the synthesis frequency, in force for said preceding pitch, of another modulated component of the harmonized remanent audio signal of contact, named high rank component, are modulated each towards a harmonic frequency of said new pitch, chosen in such way that it finds itself, amongst the harmonic frequencies of the new pitch, directly neighboring the preceding synthesis frequency of the low rank component.

More particularly, advantageously and according to the invention, at least one high rank component is modulated towards a harmonic frequency of the new pitch, chosen so as to maintain constant the difference between the harmonic ranks of the synthesis frequencies of the high rank component and of an associated low rank component.

Advantageously and according to the invention, the sequencing signal is produced from a signal, named source signal for excitation detecting, representative of the vibration of the vibrating body, in such way that the sequencing signal is representative, for different frequency bands, named excitation bands, of the source signal for excitation detecting, of at least one intensity value of excitation of each excitation contact in each of said excitation bands.

Advantageously and according to the invention a signal, named note variation signal, representative of a pitch variation rate is produced from the transposition signal, and the new synthesis frequency is chosen amongst the harmonic frequencies of the new pitch according to the note variation signal.

Advantageously and according to the invention, several modulated components of the harmonized remanent audio signal of contact are each modulated:

according to data, named synthesis rank data, representative of a preceding harmonic rank, named synthesis rank, to which corresponds a preceding synthesis frequency of the modulated component, and according prerecorded data comprising, for several predefined intervals of pitch variation rate, data representative of synthesis rank update values.

Advantageously and according to the invention, the transposition signal is produced from a signal representative of the vibrating body's vibration according to an octave of detection of pitch.

Detecting partial attenuations of high frequency components common to the vibration signal and the source signal for extracting harmonic frequency(ies) of vibration can be tricky given the often relatively high damping rate of these components in free vibration (damping from the air, energy loss at the points of contacts and structural friction inside the vibrating body). Such is notably the case of a mounted string under tension. Advantageously and according to the invention, at least one frequency component, named high component, of a remanent audio signal of contact, is attenuated according to a mean attenuation value, determined from several partial attenuation values of remanence specific to frequency components, named low components, held in low frequency bands with respect to a frequency band holding said high component. Hence, the invention allows for producing audio signals of contacts both representative of a high-pitched part of a synthesis timbre to be reproduced and of the playing of the instrumentalist.

Advantageously and according to the invention, the sequencing signal is also representative of an intensity of excitation of each excitation contact. More particularly, advantageously and according to the invention:

the sequencing signal is representative, for each excitation contact, of at least one intensity value of excitation determined from values of the source signal for excitation detecting, belonging to a time interval, named interval of detection of intensity of excitation contact, during which the excitation contact is carried out on the vibrating body, said partial attenuation value of remanence is determined from values of said vibration signal, belonging to a time interval presenting a upper boundary concomitant or subsequent to the upper boundary of the interval of detection of intensity of excitation contact corresponding to the partial contact.

Advantageously and according to the invention, the sequencing signal is representative, for different frequency bands of the vibration signal, named excitation bands, of at least one intensity value of excitation of each excitation contact in each of said excitation bands. In particular, advantageously and according to the invention, the sequencing signal is in addition representative of different phase values of excitation of each excitation contact in each excitation bands.

In particular, said contact data comprises data produced by comparing between several first values extracted from the source signal for excitation detecting on a first time interval of the source signal for excitation detecting, and several values determined from several second values extracted from the source signal for excitation detecting on a second time interval of the source signal for excitation detecting, and according to a predetermined prediction model of the variation in time of the source signal for excitation detecting between the first and the second intervals. In particular, advantageously and according to the invention, said contact data comprises data produced by doing a projection between a first waveform extracted from the source signal for excitation detecting, and a second waveform determined from a waveform extracted from the source signal for excitation detecting on a second interval of time of the source signal for excitation detecting, the second interval being previous to the first time interval, and according to a predetermined prediction model of the variation in time of the vibration signal between the first and second interval.

Advantageously and according to the invention, the vibration signal is representative of the vibration of a vibrating body unequipped with any added damping means, under the effect of the partial contact.

Advantageously and according to the invention, the vibration signal is representative of the vibration of a mounted string under tension, under the effect of the partial contact.

The invention extends to a device for carrying out a process according to the first aspect of the invention.

The first aspect of the invention thus relates to a synthesis device comprising at least one processing unit adapted for:

synthesizing an audio signal, named synthesized audio signal, from a sequencing signal representative of a sequence of contacts carried out on a vibrating body, said sequence comprising excitation contacts suitable for bringing the vibrating body into vibration, producing at least one audio signal, named audio signal of contact, for each of said excitation contacts, being capable of producing a signal, named partial attenuation signal of remanence, from a signal, named vibration signal, representative of the vibration of the vibrating body generated by at least one excitation contact, named partial contact, the partial attenuation signal of remanence being representative, for said partial contact, of at least one partial attenuation value of remanence of at least one audio signal of contact, named remanent audio signal of contact, resulting from an excitation contact that is previous to said partial contact, producing, after any partial contact, the synthesized audio signal by mixing the audio signal of contact of said partial contact and each corresponding remanent audio signal of contact affected by the partial attenuation signal of remanence.

The first aspect of the invention relates more particularly to a synthesis device comprising:

at least one inlet of at least one signal, named vibration signal, representative of the vibration of the vibrating body, at least one processing unit of said vibration signal, adapted for:

synthesizing an audio signal, named synthesized audio signal, from a sequencing signal representative of a sequence of contacts carried out on a vibrating body, said sequence comprising excitation contacts suitable for bringing the vibrating body into vibration, producing at least one audio signal, named audio signal of contact, for each of said excitation contacts, being capable of producing a signal, named partial attenuation signal of remanence, from a signal, named vibration signal, representative of the vibration of the vibrating body generated by at least one excitation contact, named partial contact, the partial attenuation signal of remanence being representative, for said partial contact, of at least one partial attenuation value of remanence of at least one audio signal of contact, named remanent audio signal of contact, resulting from an excitation contact that is previous to said partial contact, producing, after any partial contact, the synthesized audio signal by mixing the audio signal of contact of said partial contact and each corresponding remanent audio signal of contact affected by the partial attenuation signal of remanence.

Advantageously and according to the invention, the device comprises means for detecting a sequence of contacts carried out on the vibrating body by an instrumentalist, and wherein the processing unit is adapted for being capable of producing the sequencing signal from a sequence of contacts carried out on a vibrating body by an instrumentalist, detected by said means for detecting.

Advantageously and according to the invention, the processing unit is adapted for being capable of producing the sequencing signal from a signal, named source signal for excitation detecting, representative of the vibration of the vibrating body, as the reception of the source signal for excitation detecting takes place.

Advantageously and according to the invention, the processing unit is capable of carrying out a synthesis process conform to the first aspect of the invention.

The first aspect of the invention extends to a recording medium—in particular of the removable type (CD-ROM, DVD, USB key, external electronic hard disk etc.)—adapted for being capable of being read in a reader of a data-processing device, and on which is recorded a computer program adapted for being capable of being loaded in a random-access memory of said data-processing device when the recording medium is loaded in said reader, wherein the computer program comprises portions of program code for the execution of the steps of a process for synthesis of an audio signal according to the first aspect of the invention when the computer program is loaded into the random-access memory of the data-processing device.

The first aspect of the invention extends to a computer program comprising portions of program code for the execution of the steps of a process for synthesis of an audio signal according to the first aspect of the invention when said program is executed on a data-processing device.

In particular, such a data-processing device can comprise at least one input linked to a sensor sensing the vibration of the vibrating body under the effect of excitation contacts in order to allow producing in real time a synthesized audio signal according to the first aspect of the invention.

The invention extends moreover to a device for carrying out a process according to the second aspect of the invention.

The second aspect of the invention thus relates to a synthesis device comprising at least one processing unit adapted for:

synthesizing an audio signal, named synthesized audio signal, from:

a sequencing signal representative of a sequence of contacts carried out on a vibrating body, said sequence comprising excitation contacts suitable for bringing the vibrating body into vibration, and a signal, named transposition signal, resulting from a sequence of contacts of changes in pitch of the vibrating body's vibration carried out on the vibrating body, the transposition signal being representative, for each contact of change in pitch, of at least one harmonic frequency corresponding to a pitch resulting from the contact of change in pitch, producing at least one audio signal of contact for each of said excitation contacts, modulating several frequency components, named modulated components, of at least one audio signal of contact, named tonal signal of contact, each successively around harmonic frequencies, named synthesis frequencies, each specific to a harmonic rank of a pitch of the sequence of contacts of changes in pitch, device in which:

for at least one excitation contact, named excitation contact of change in pitch, causing a change in pitch towards a new pitch, the processing unit is adapted for being capable of modulating at least one modulated component, named channeled component, of a tonal signal of contact, named harmonized tonal signal, resulting from an excitation contact that is previous to said excitation contact of change in pitch, around a harmonic frequency, named new synthesis frequency, of the new pitch, corresponding to a harmonic rank different from the harmonic rank of a preceding synthesis frequency of the channeled component, the processing unit is adapted for producing, after any excitation contact of change in pitch, the synthesized audio signal by mixing each corresponding harmonized tonal signal and the audio signal of contact of said excitation contact of change in pitch.

Advantageously and according to the invention, the processing unit is capable of carrying out a synthesis process conform to the second aspect of the invention.

The second aspect of the invention extends to a recording medium—in particular of the removable type (CD-ROM, DVD, USB key, external electronic hard disk etc.)—adapted for being capable of being read in a reader of a data-processing device, and on which is recorded a computer program adapted for being capable of being loaded in a random-access memory of said data-processing device when the recording medium is loaded in said reader, wherein the computer program comprises portions of program code for the execution of the steps of a process for synthesis of an audio signal according to the second aspect of the invention when the computer program is loaded into the random-access memory of the data-processing device.

The second aspect of the invention extends to a computer program comprising portions of program code for the execution of the steps of a process for synthesis of an audio signal according to the second aspect of the invention when said program is executed on a data-processing device.

In particular, such a data-processing device can comprise at least one input linked to a sensor sensing the vibration of the vibrating body under the effect of excitation contacts in order to allow producing in real time a synthesized audio signal according to the second aspect of the invention.

The invention also relates to a process, a device, a recording medium and a computer program characterized, in combination, by all or some of the characteristics mentioned above or below.

Figure 2:
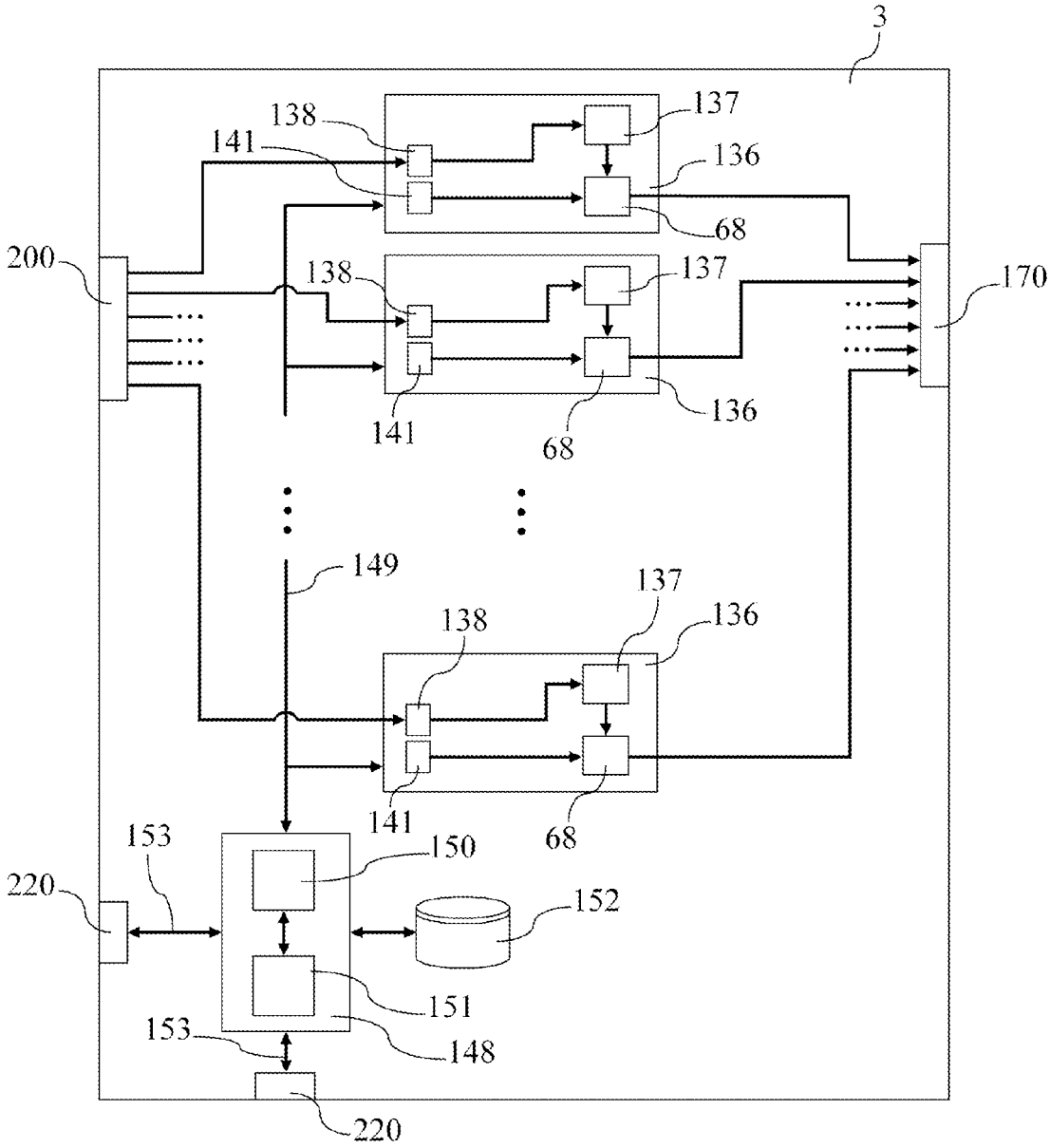
Figure 3:
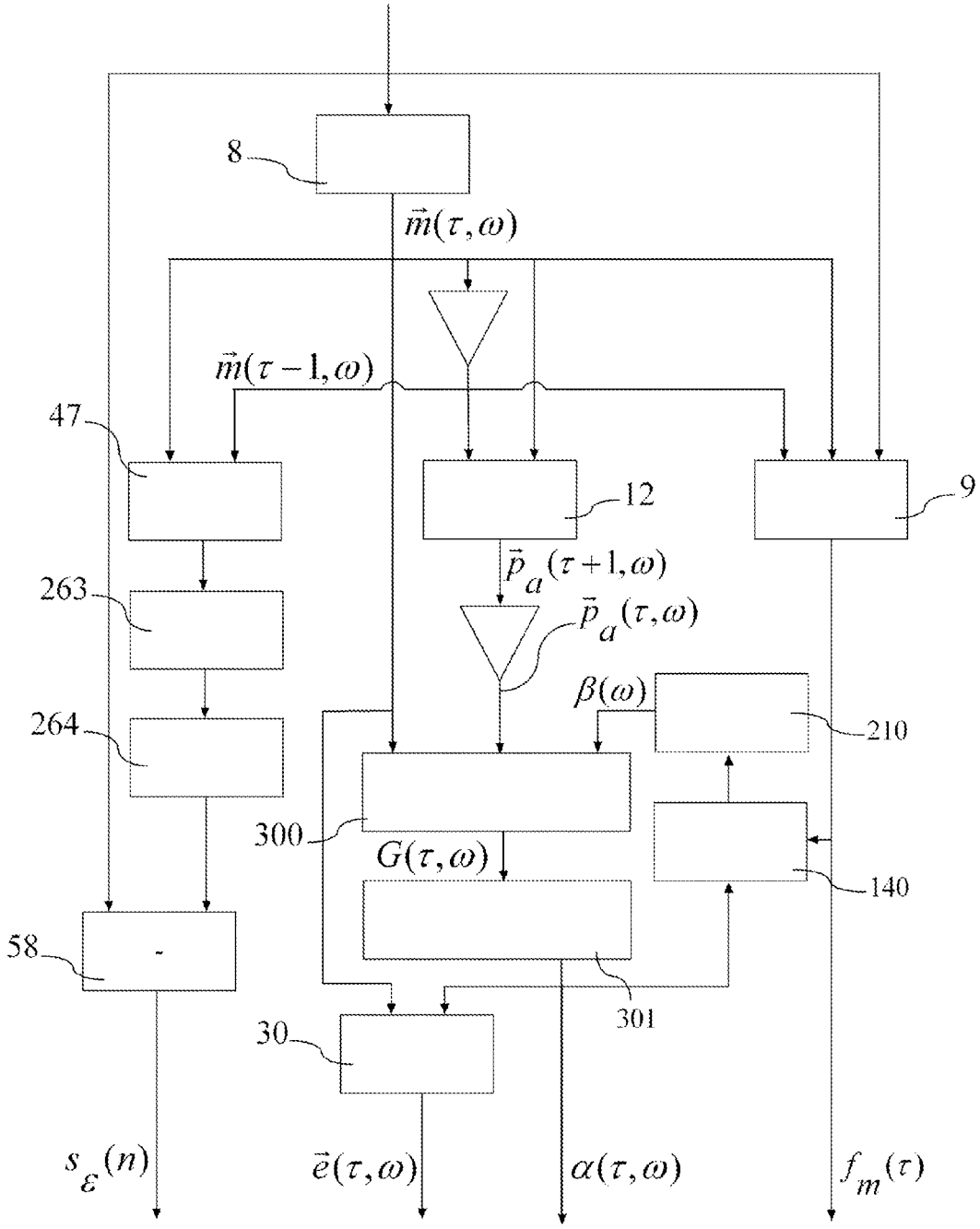
Figure 4:
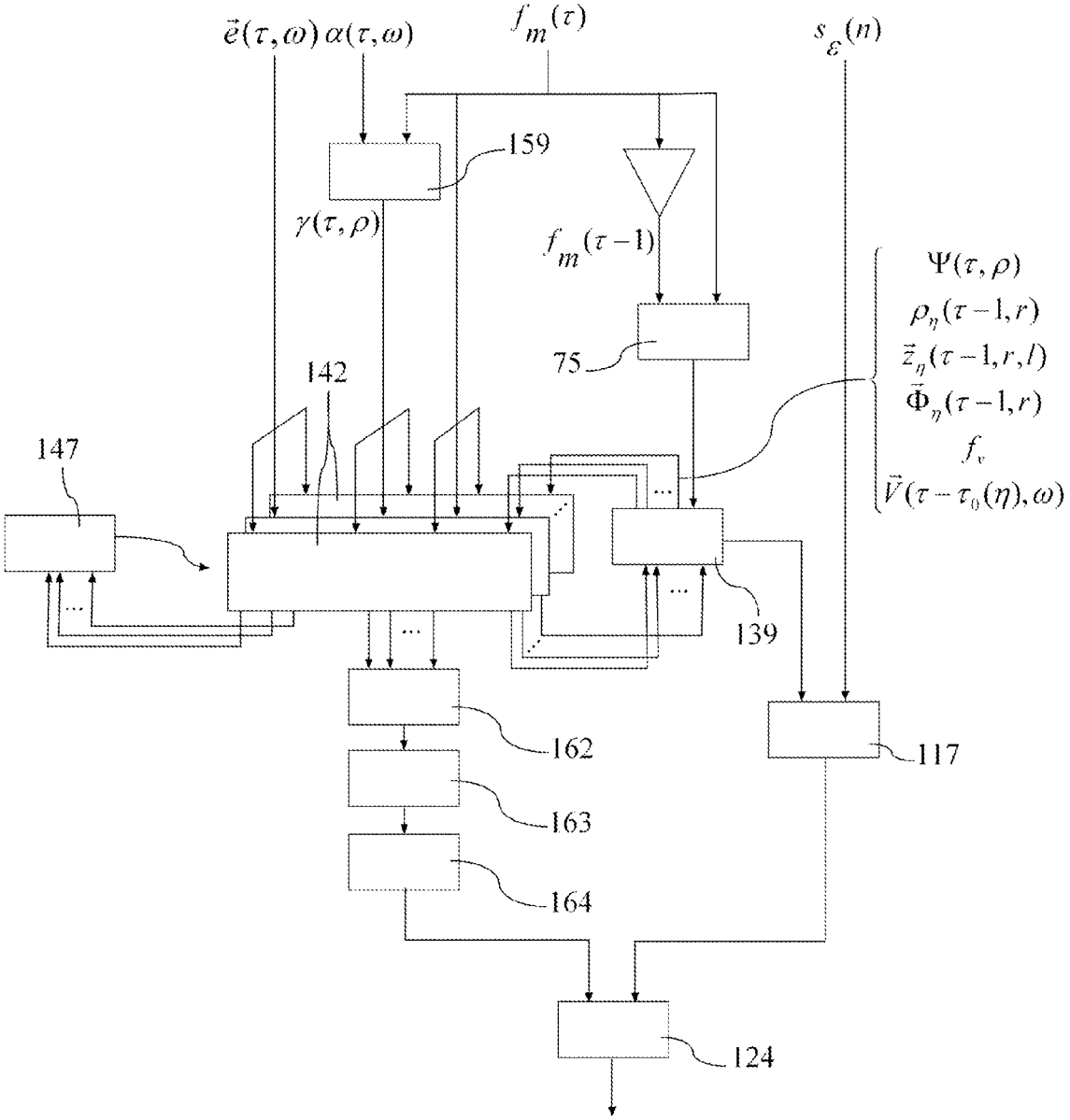
Figure 5:
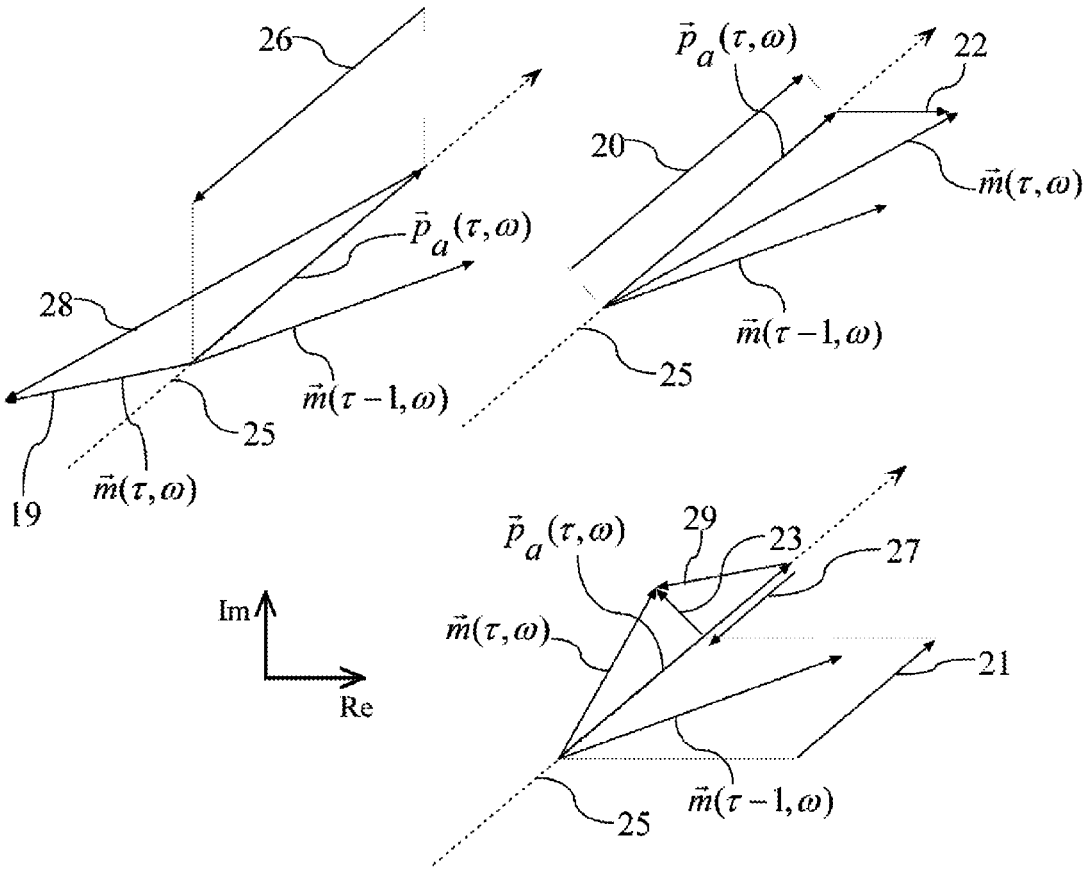
Figure 6:
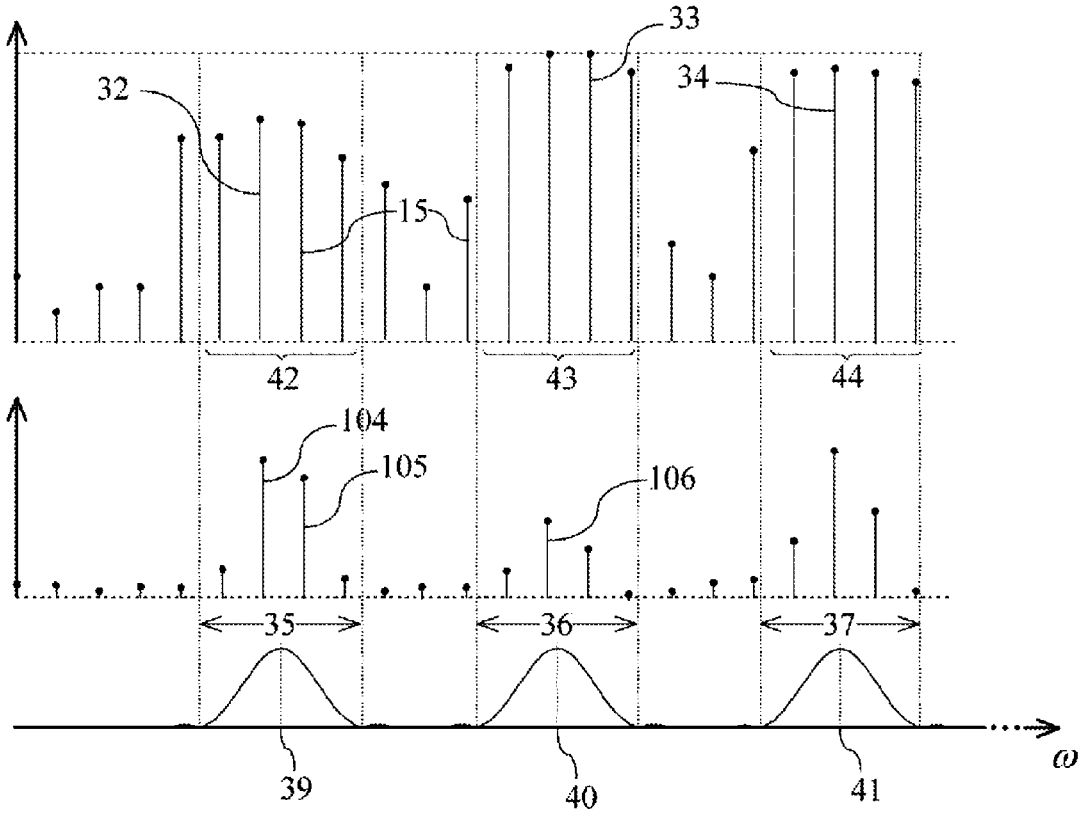
Figure 7:
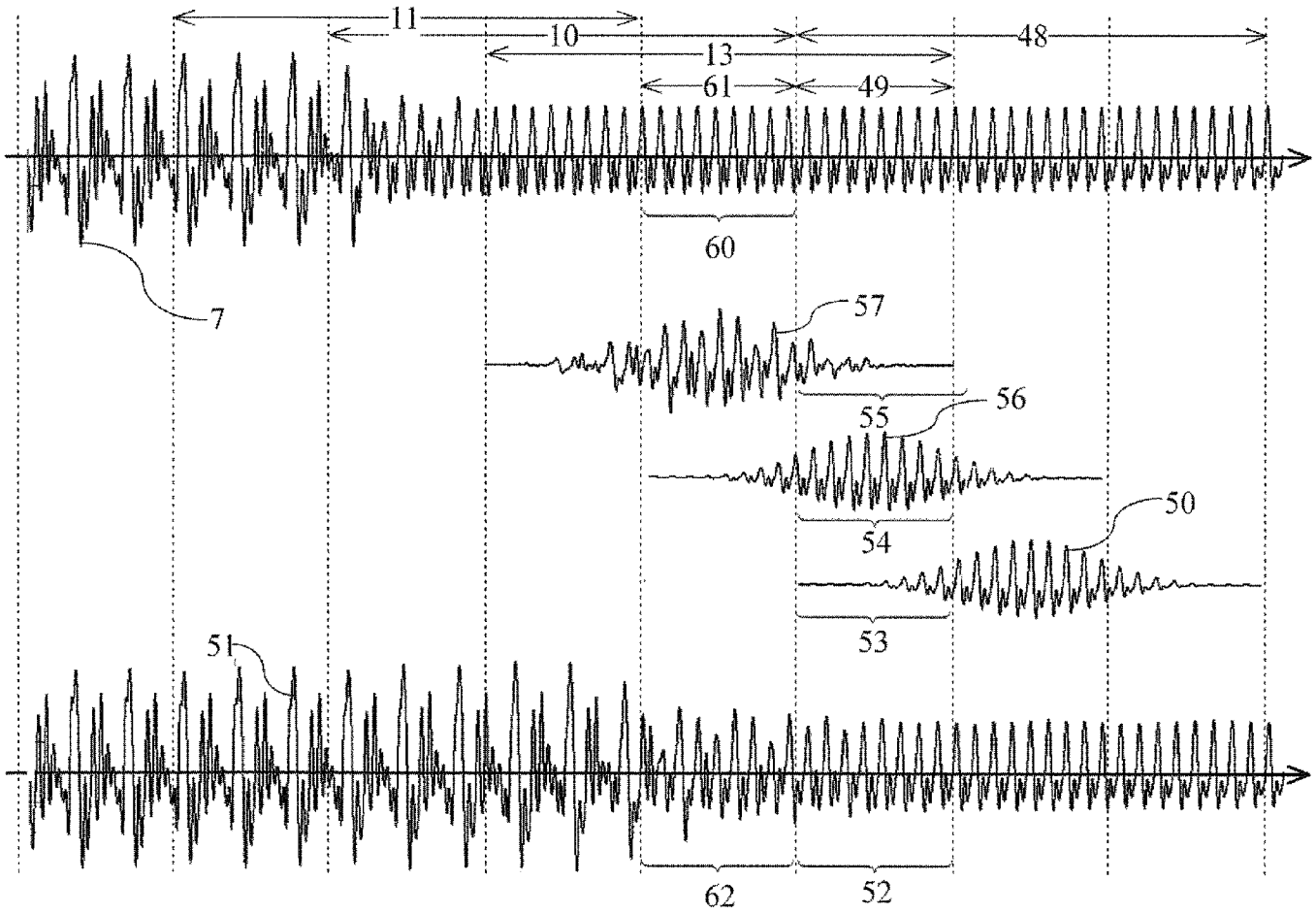
Figure 8:
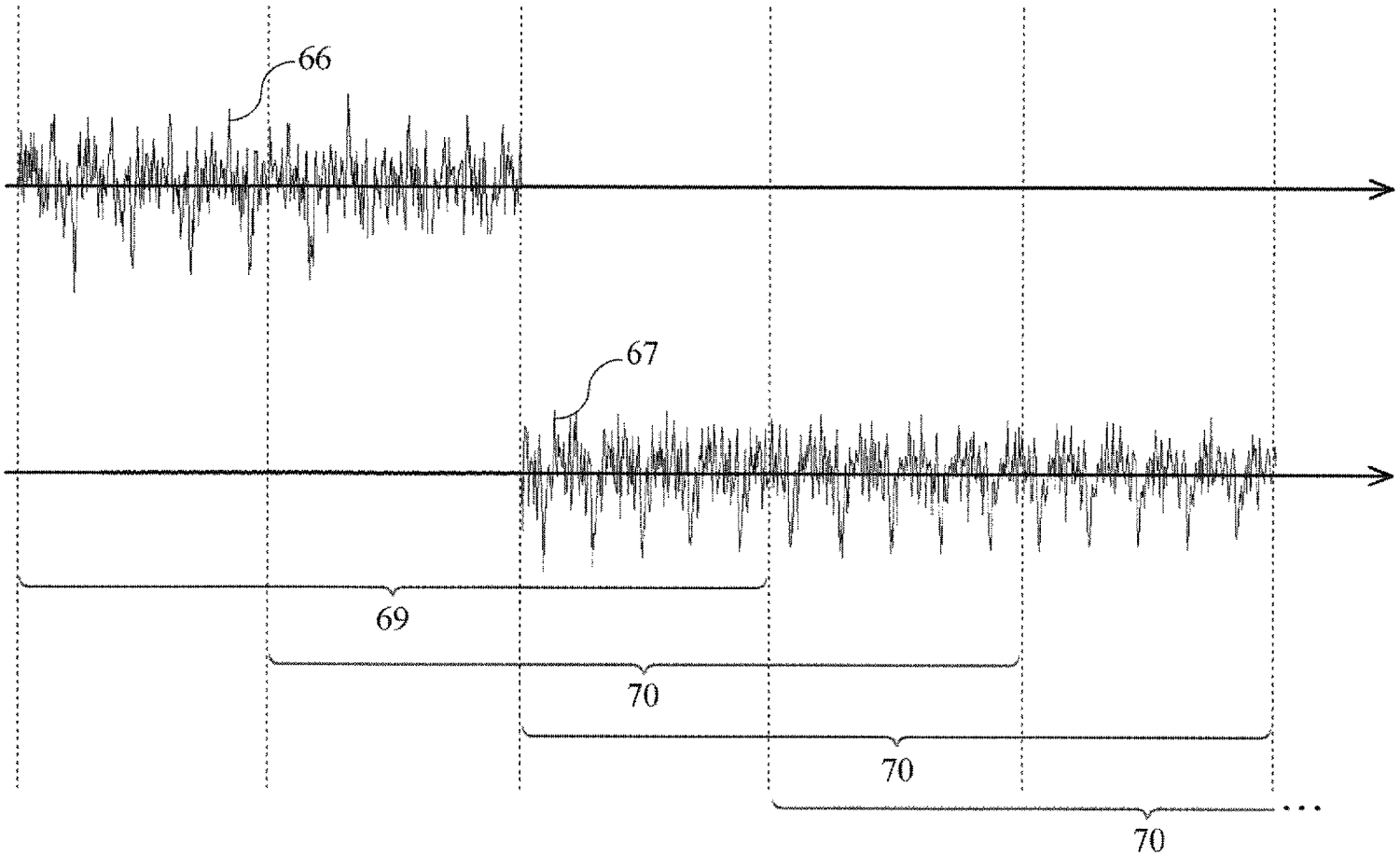
Figure 9:
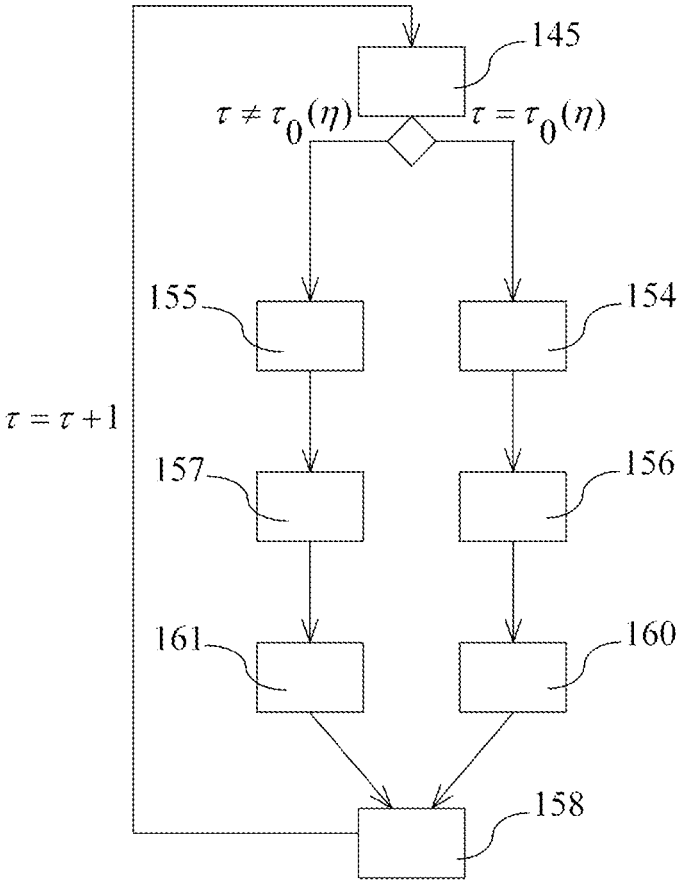
Figure 10:
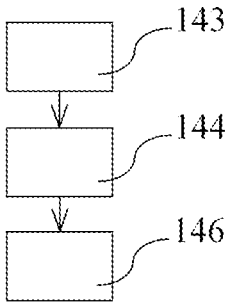
Figure 11:
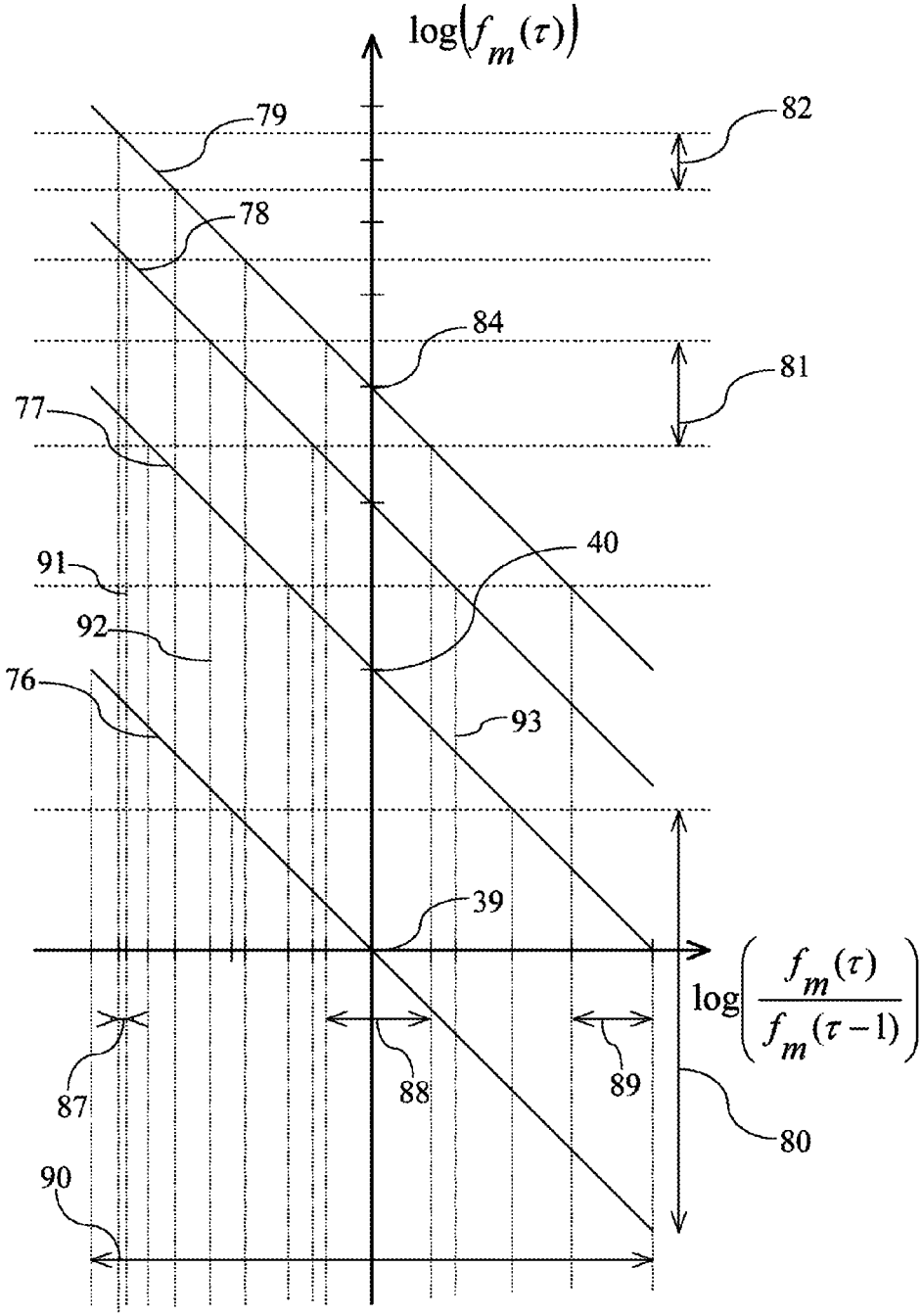
Figure 12:
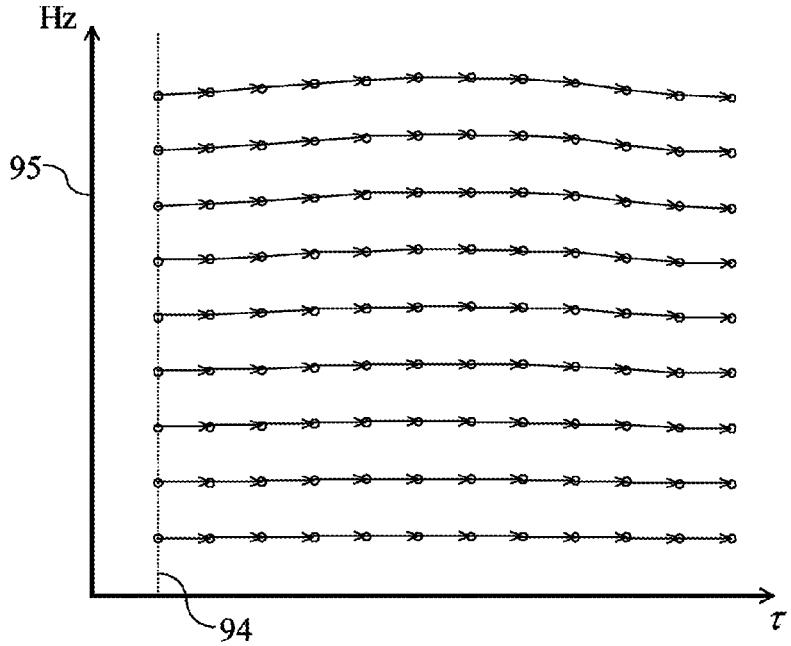
Figure 13:
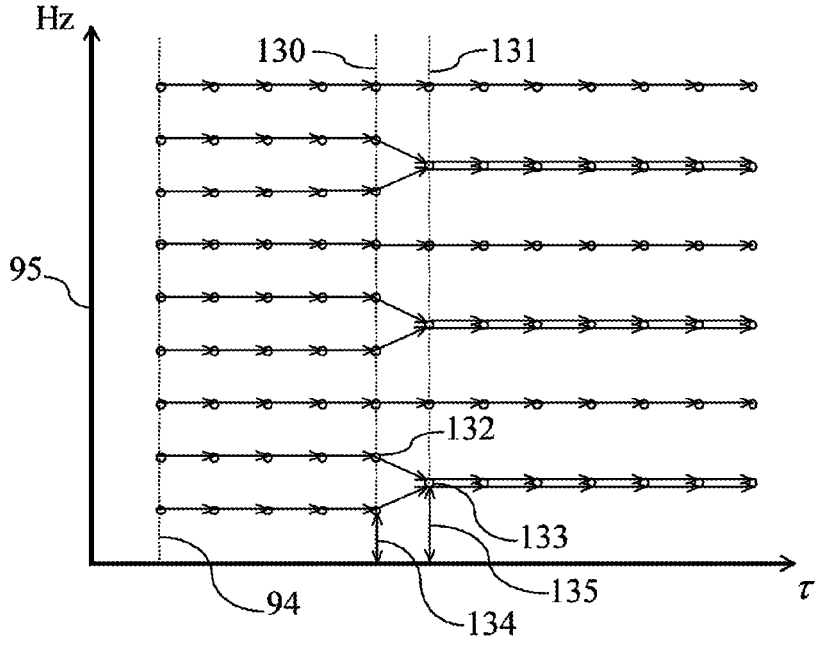
Figure 14:
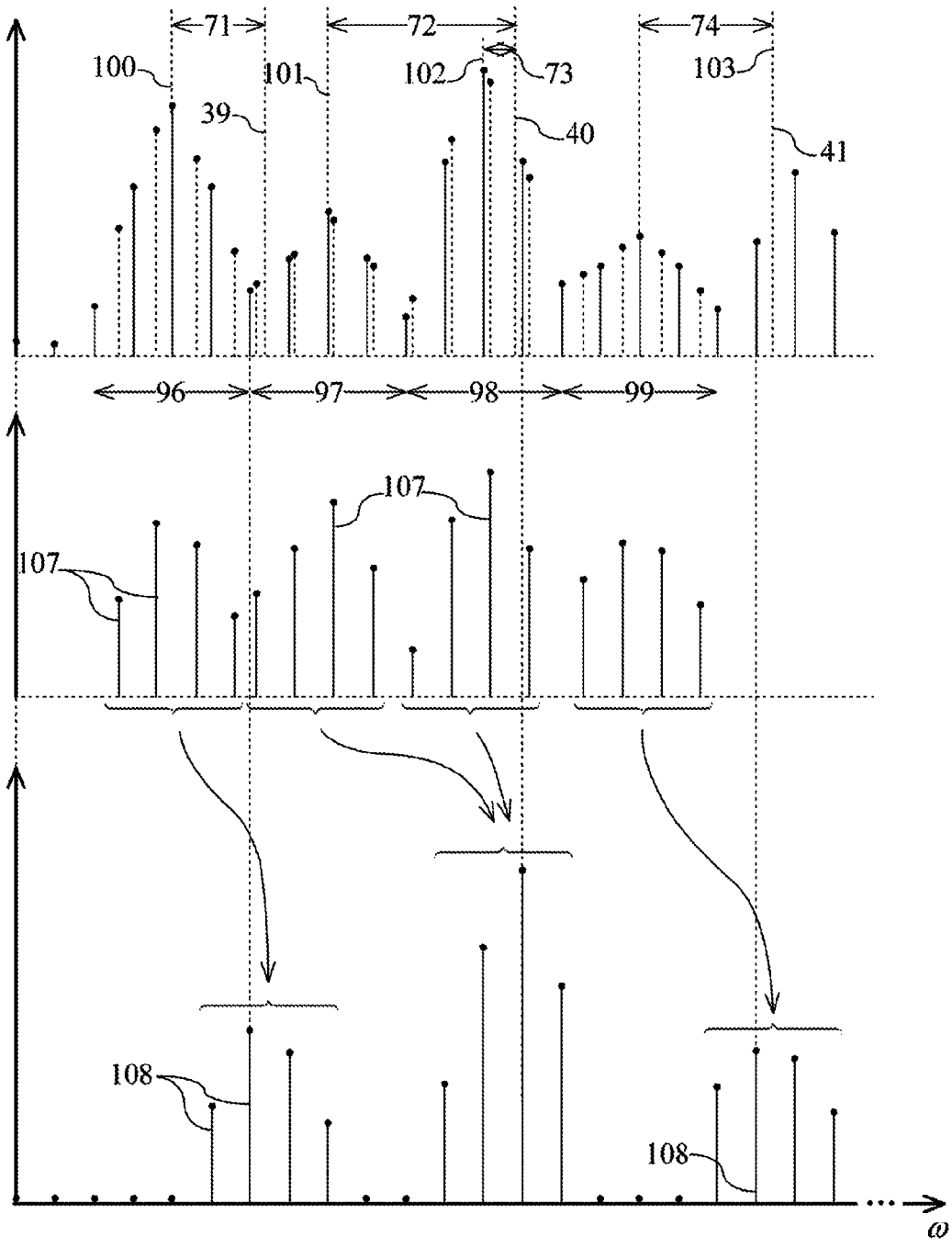
Figure 15:
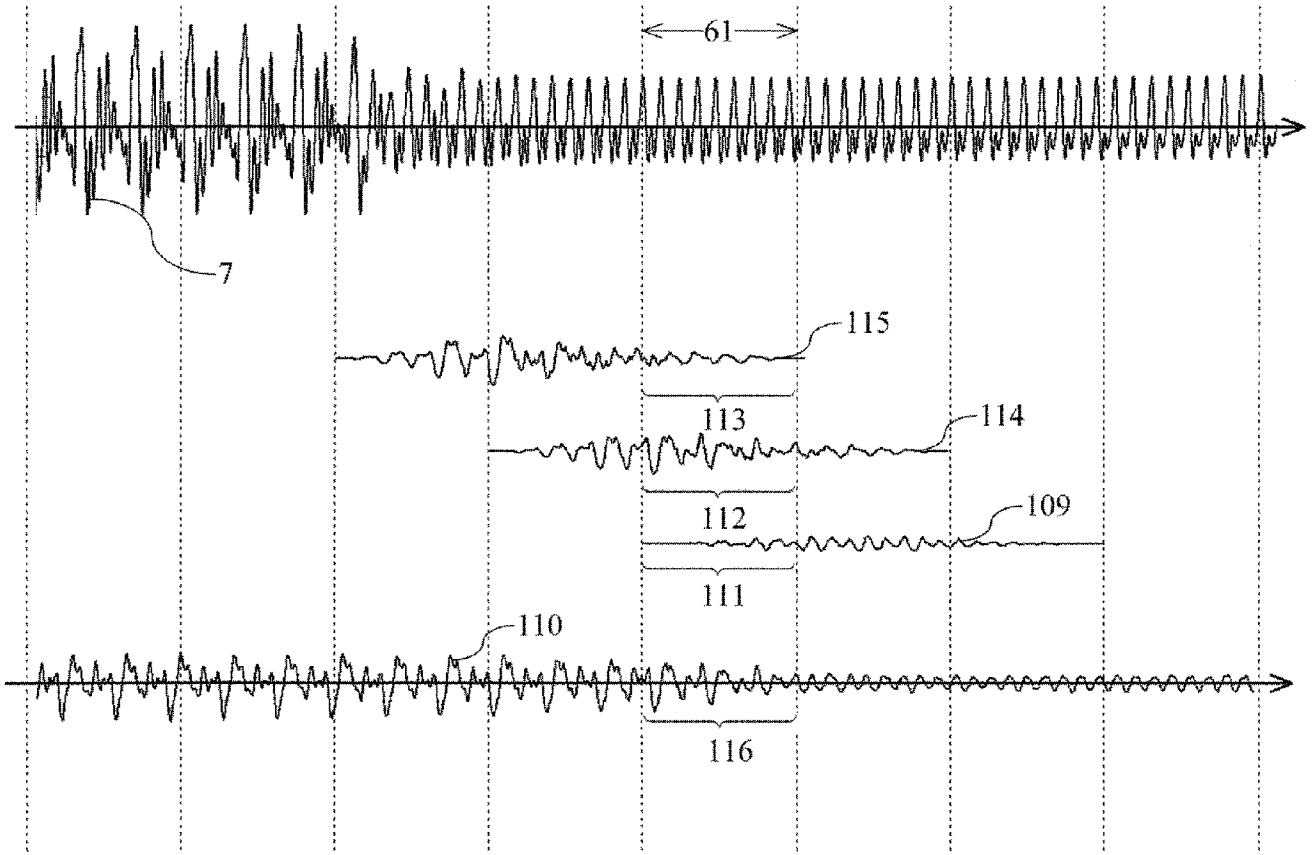
Figure 16:
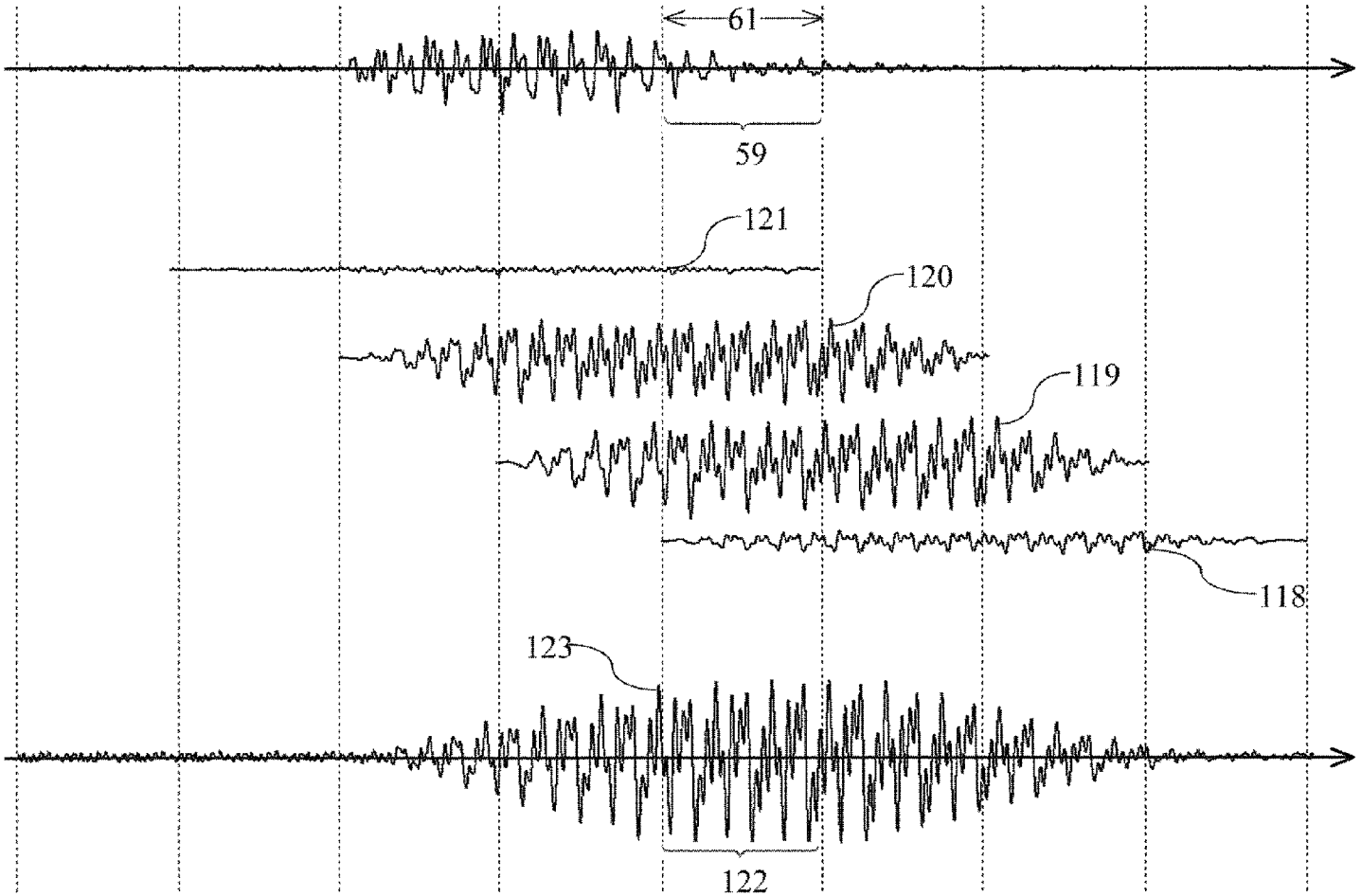

Other, goals, characteristics and advantages of the invention will become apparent on reading of the following description which refers to the appended figures representing embodiments given as non-limiting examples, and in which:

FIG. 1 is a schematic representation of an example of device according to a preferred embodiment of the invention, arranged in an in-service set-up with an audio amplifier and a guitar equipped with an hexaphonic pickup, FIG. 2 is a detailed schematic representation of embedded electronic and data-processing components equipping the device of FIG. 1, FIG. 3 is a schematic functional diagram of a detection circuit equipping a synthesizer peripheral of the device of FIG. 1, FIG. 4 is a schematic functional diagram of a synthesis circuit equipping said synthesizer peripheral, FIG. 5 is a schematic representation in the complex plane of frequency sample of measurement values and corresponding predicted frequency sample values, illustrating an attenuation detecting principle applied by the detection circuit of FIG. 3, said values being given as illustrative and non-limiting examples, FIG. 6 is a schematic representation of values of digital frequency samples of attenuation and amplitude values of digital frequency samples of excitation, produced for various frequency bands of a frequency representation, said values being given as illustrative and non-limiting examples, FIG. 7 is a diagram representing the waveform of a digital signal of measurement, and the waveform of a corresponding prediction signal produced by the detection circuit of FIG. 3 from the digital signal of measurement, said waveforms being given as illustrative and non-limiting examples, FIG. 8 represents the waveforms of a first part and the beginning of a second part of a filtered digital signal from which is produced timbre data saved in a memory of the synthesis circuit of FIG. 4, said waveforms being given as illustrative and non-limiting examples, FIG. 9 represents an algorithmic diagram according to which generator modules of the synthesis circuit of FIG. 4 run, FIG. 10 represents an algorithmic diagram of a in-frequency modification step, iteratively executed by each generator module, FIG. 11 represents preceding transposition frequency values of frequency contributions of a modified sound, according to a current variation rate of a detected fundamental value, FIG. 12 is a graph representing the in-frequency trajectories of several frequency contributions of a modified sound produced by a generator module of the synthesis circuit as successive iterations are taking place, said trajectories being given for a first illustrative and non-limiting example, FIG. 13 is a graph representing the in-frequency trajectories of the low frequency contributions of a modified sound, given for a second illustrative and non-limiting example, FIG. 14 is a diagram representing in-frequency modifications of the filtered digital signal of FIG. 8, implemented by a generator module, said modifications being given as illustrative and non-limiting examples, FIG. 15 is a diagram representing the waveform of the digital signal of measurement of FIG. 7, and the waveform of a resulting tonal synthesis signal produced by the synthesis circuit of FIG. 4, said waveforms being given as illustrative and non-limiting examples, FIG. 16 is a diagram representing the waveform of a perturbation signal produced from the digital signal of measurement and the prediction signal of FIG. 7, and also the waveform of an inharmonic synthesis signal produced from the perturbation signal and the first part of the filtered signal of FIG. 8, said waveforms being given as illustrative and non-limiting examples.

FIG. 1 represents a device 3 according to a preferred embodiment of the invention linked to a hexaphonic pickup equipping a guitar 1 by means of a appropriate transmission cable 4, said hexaphonic pickup being adapted for transmitting one microphone signal for each string 2 of the guitar 1 through the transmission cable 4, said microphone signal being representative of the vibration of the string when it is brought into vibration by effects of excitation contacts carried out on the string. In particular, the hexaphonic pickup can be of any type comprising a piezoelectric, electromagnetic or optical sensor for each string, for example a hexaphonic pickup marketed by RMC Pickup Co. (USA), Graph Tech Guitar Labs (Canada), Roland corp. (Japan) . . . .

The device 3 of FIG. 1 comprises a rigid casing 5 in which is installed a socket 6 equipped with an input circuit 200 of the microphone signals of measurement. The casing 5 contains a central data-processing unit 148, equipped of at least one processor 150 running according to an embedded computer program loaded in a random-access memory 151 associated to the processor 150. In particular, the embedded computer program can be saved in a mass memory 152 and loaded in the random-access memory following power-on of the device 3.

The casing 5 contains furthermore, for each string 2 of the guitar, a synthesizer peripheral 136 equipped with a detection circuit 137. Each synthesizer peripheral 136 of the example is in addition equipped of a analog to digital converting circuit 138 electrically connected to the detection circuit 137 and to an output port of the input circuit 200 delivering the corresponding microphone signal. In a traditional way, the analog to digital converting circuit 138 is adapted to receive the string's 2 microphone signal, sample and quantify said microphone signal, and transmit a resulting signal, named digital signal 7 of measurement, to the detection circuit 137. It is to be noted that only three synthesizer peripherals are represented in FIG. 2 for better clarity.

The device 3 of the example comprises in addition a socket 63 for plugging of a removable recording medium 64, installed in the rigid casing 5, and means 65 for data entry, —pedal(s), wheel(s), buttons(s), screen(s) . . . —, said socket and said means for data entry being connected to the central data-processing unit 148 by means of a data bus 153 and corresponding input/output interfaces 220. The central data-processing unit 148 is adapted for running in a prerecorded sounds loading mode, in which a digital file of a prerecorded sound can be selected, through the means 65 for data entry, for each string of the guitar amongst several digital files previously saved by any means in the removable recording medium 64. The central data-processing unit 148 reads the digital data of the file in the removable recording medium 64 according to the format of the file, for example a format of the pulse code modulation type, and transmits samples, named sound source samples, representative of the waveform of the corresponding sound, named selected sound, to the corresponding synthesizer peripheral 136, through a data bus 149 connecting the central data-processing unit 148 and said synthesizer peripheral 136.

Each synthesizer peripheral 136 of the example comprises in addition a sound preprocessing circuit 141 and a synthesis circuit 68, and is adapted to run, following reception of said sound source samples, in a loading mode of the selected sound. In that mode, said sound preprocessing circuit 141 produces timbre data from the sound source samples and transmits said timbre data to the synthesis circuit 68 who saves them in a memory 139 equipping said synthesis circuit 68.

In the example, each synthesizer peripheral 136 is in addition adapted to operate, after a corresponding command inputted through the means for data entry 65, and transmitted by the central data-processing unit 148, in an interactive mode of sound synthesis in which the synthesizer peripheral 136 synthesizes in real time a sound sequence signal (not represented) from the digital signal 7 of measurement and the timbre data loaded in memory 139 of the synthesis circuit 68.

The detection circuit 137 of the example comprises an in-frequency transformation module 8 carrying out a sliding window digital Fourier transform method, the module 8 producing, for each of several successive time intervals of the digital signal 7 of measurement, digital frequency samples of measurement descriptive of a frequency representation of the digital signal 7 of measurement during the time interval, named observation window. Preferably, a fast Fourier transform is carried out iteratively as the digital signal 7 of measurement is captured, according to successive observation windows 10, 11, 13, overlapping according to a step, named shift step, corresponding to a predetermined number of samples of the digital signal 7 of measurement.

Preferably, the Fourier transform is carried out according to observation windows 10, 11, 13, of length several times superior to a open-string nominal fundamental period of the string 2 corresponding to the synthesizer peripheral 136, so a to allow using a windowing function improving the effectiveness, obtained in the frequency transformation, of the separation of the harmonic frequency components. For information, using an Hann or Hamming window implies an observation window length at least two times superior than the fundamental period of the open string, using a four term Blackman-Harris window implies a length four times superior . . . . Nil values can be added following the sample sequence, in accordance with a traditional technique, named zero-padding method, of interpolation of the frequency representation. This method allows for advantageously reducing the sampling step in the Shannon-Nyquist band.

Given the above, each digital frequency sample of measurement is representative of a frequency component of the digital signal 7 of measurement held in a frequency band whose width corresponds to the main lobe of the windowing function.

The sound preprocessing circuit 137 comprises in addition a pitch detection module 9 adapted for producing a digital signal, named fundamental signal, from the digital signal 7 of measurement, in such way that said fundamental signal is representative of a current detected fundamental value for each observation window of the frequency transform.

In the example, the pitch detection module 9 comprises a pitch detection sub-module (not represented) adapted for providing upon each iteration, a preliminary fundamental value detected for that iteration. In practice, a traditional pitch detecting technique can be carried out from the samples of the digital signal 7 of measurement of the current observation window. In particular, an in-time detection technique can be used, for example a detection by autocorrelation of the digital signal of measurement (cf. McLeod et Wyvill, *A smarter Way to Find Pitch*, Department of Computer Science of the University of Otago—New-Zealand). Alternatively, an in-frequency detection technique can be used, for example a detection technique from a frequency representation of the digital signal of measurement according to a logarithmic scale of the frequency, as taught in publications of Puckette and Brown: *An efficient algorithm for the calculation of a constant Q transform* (Journal of the Acoustical Society of America, vol. 92, no. 5, November 1992) and *A high resolution fundamental frequency determination based on phase changes of the Fourier transform* (Journal of the Acoustical Society of America, vol. 94, no. 2, pt. 1, August 1993). Nothing stops one from using other types of techniques.

The pitch detection module 9 of the example comprises in addition a phase vocoder refinement sub-module (not represented) for refining the detected preliminary fundamental value. In practice, a value $f_{max}$ of refined measure of the frequency can be determined for a digital frequency sample of measurement, named maximum sample, of maximal amplitude value for the current observation window according to the phase variation value of said maximum sample with comparison to the preceding iteration's digital frequency sample of measurement of corresponding index. The following formula illustrates this principle:

$$f_{max}(\tau) = f_s \cdot \frac{\theta(\tau, \omega_{max}) - \theta(\tau - 1, \omega_{max}) + 2\pi \cdot cste}{2\pi \cdot \Delta}$$

In this formula:

- $\Delta$ represents the duration of the shift step in numbers of samples,
- $\tau$ represents the index of the current iteration,
- $\omega_{max}$ represents the maximum sample's index in the frequency representation,
- $f_S$ represents the sampling frequency in Hertz of the digital signal of measurement,
- $\theta$ represents the phase in the frequency representation,
- cste is an integer to be determined in such way that the value of refined measure of the frequency $f_{max}$ is the closest to a central frequency of the frequency band of the Fourier transform to which corresponds the maximum sample's index.

The pitch detection module 9 of the example is adapted for producing upon each iteration, a digital sample of the fundamental signal according to the value $f_{max}$ of refined measure of frequency of a harmonic rank value to which corresponds the maximum sample, given the detected preliminary fundamental value. The following formula illustrates this principle:

$$f_m(\tau) = \frac{1}{r_{max}(\tau)} f_{max}(\tau)$$

In this formula:

- $f_m(r)$ represents the resulting current detected fundamental value for iteration $\tau$,
- $r_{max}(\tau)$ represents the harmonic rank closest in frequency to the value $f_{max}$ of refined measure of the frequency given the detected preliminary fundamental value.

In the example, the pitch detection module 9 is adapted for producing a fundamental signal whose values are comprised in a detection interval of one octave extending towards the high frequencies from a nominal fundamental frequency of the vibration of the open string. In particular, a parameter of the pitch technique can be adjusted to this end, for example the range of shift values for which a value of the autocorrelation signal is produced in an in-time technique using autocorrelation. Furthermore, the pitch detection module 9 can be adapted for forcing any detected value of pitch in the detection interval, by transposing said value of an appropriate number of octave.

The detection circuit 137 of the example further comprises a module, named short-term prediction module 12, for predicting phase values of the digital frequency samples of measurement of the next observation window 13. In practice, the short-term prediction module 12 of the example is adapted for producing upon each iteration a digital frequency sample, named preliminary sample $\vec{P}_a(\tau+1,\omega)$, from each digital frequency sample of measurement, named current measure sample $\vec{m}(\tau,\omega)$, resulting from the current observation window 10 and from the digital frequency sample of measurement, named preceding measure sample $\vec{m}(\tau-1,\omega)$, of corresponding index resulting from the preceding observation window 11. In practice, the preliminary sample $\vec{P}_a(\tau+1,\omega)$ can be produced in accordance with the principle of the following formula:

$$\vec{P}_a(\tau+1,\omega)=\frac{\vec{m}(\tau,\omega)^2}{\vec{m}(\tau-1,\omega)}\cdot\frac{|\vec{m}(\tau-1,\omega)|}{|\vec{m}(\tau,\omega)|}$$

Given the above, the preliminary sample $\vec{P}_a(\tau+1,\omega)$ is representative of an amplitude value corresponding to the one of the current measure sample $\vec{m}(\tau,\omega)$ and of a phase corresponding to the sum of the phase value of the current measure sample $\vec{m}(\tau,\omega)$ and of a value of phase shift between the current measure sample $\vec{m}(\tau,\omega)$ and the preceding measure sample $\vec{m}(\tau-1,\omega)$.

According to a phase coherence principle, each frequency sample held in the main lobe of the Fourier transform of a sinusoid presents a specific phase shift relative to each neighboring frequency samples in the lobe. The following formula defines a theoretical value $\delta\theta$ of the phase shift of a frequency sample of the positive frequency part of Shannon-Nyquist's band, comprised in the lobe of a sinusoid, compared with a leftward adjacent frequency sample in the lobe:

$$\delta\theta=\frac{W-1}{N}\cdot\pi$$

In this formula, W represents the length of the observation windows in numbers of sample, and N represents the number of frequency samples of the corresponding frequency representations (N>W if the zero-padding method is implemented).

Given the above, the preliminary sample $\vec{P}_a(\tau+1,\omega)$ values are phase shifted compared with current measure sample $\vec{m}(\tau,\omega)$ values, with shift values that are different from an adjacent preliminary sample $\vec{P}_a(\tau+1,\omega)$ to another, making it likely to break a phase coherence that possibly exists between the current measure sample $\vec{m}(\tau,\omega)$ values. To palliate this problem, the short-term prediction module 12 of the example processes the preliminary sample $\vec{P}_a(\tau+1,\omega)$ in accordance with the principle illustrated in the following formula:

$$\vec{p}_a(\tau+1,\omega)=|\vec{P}_a(\tau+1,\omega)|\cdot\frac{e^{-i\delta\theta}\vec{P}_a(\tau+1,\omega-1)+\vec{P}_a(\tau+1,\omega)+e^{i\delta\theta}\vec{P}_a(\tau+1,\omega+1)}{|e^{-i\delta\theta}\vec{P}_a(\tau+1,\omega-1)+\vec{P}_a(\tau+1,\omega)+e^{i\delta\theta}\vec{P}_a(\tau+1,\omega+1)|},\ \omega\geq 1$$

In this formula, $\vec{p}_a(\tau+1,\omega)$ designates the predicted sample value, produced at the output of the short-term prediction module 12. Preferably the complex factors $e^{i\delta\theta}$ and $e^{-i\delta\theta}$ can be predetermined and prerecorded in a memory of the short-term prediction module in order to simplify the execution of the short-term prediction module 12. In addition, in the absence of implementation of the zero-padding method, the imaginary part of the complex factors can be ignored.

The detection circuit 137 further comprises an attenuation detecting module 300, 301, adapted for producing upon each iteration a digital frequency sample, named attenuation sample, representative of an amplitude attenuation factor of the digital signal 7 of measurement, from each current measure sample $\vec{m}(\tau,\omega)$ and the predicted sample $\vec{p}_a(\tau,\omega)$ of corresponding index produced during the preceding iteration.

FIG. 5 represents, in the complex plane, three current measure sample $\vec{m}(\tau,\omega)$ value examples and three corresponding predicted sample $\vec{p}_a(\tau,\omega)$ value examples. These examples illustrate a principle for detecting attenuation that is applied by the attenuation detecting module 300, 301, of the example. According to this principle, the current measure sample $\vec{m}(\tau,\omega)$ is, if the case arises, representative of the sum of a component 20, 21, of the digital signal 7 of measurement, maintained with a nil or partial attenuation in the frequency bandwidth of the sample, with a component 22, 23, of the digital signal 7 of measurement added in the frequency band in between these iterations.

Given the above a digital frequency sample representative of the attenuation of the maintained component can be produced by means of orthogonal projection in the complex plane of the value of the current measure sample $\vec{m}(\tau,\omega)$ along the line 25 of the corresponding predicted sample $\vec{p}_a(\tau,\omega)$. In the first example of FIG. 5, the corresponding projection component (not represented) is in phase opposition with the predicted sample $\vec{p}_a(\tau,\omega)$. Hence this example corresponds to a complete attenuation, between the preceding and the current iteration, of the frequency component, named preexisting component, of the preceding measure sample $\vec{m}(\tau-1,\omega)$, the current measure sample $\vec{m}(\tau,\omega)$ being only representative of an added component. In the second example of FIG. 5, the projection component (not represented) is not in phase opposition with the predicted sample $\vec{p}_a(\tau,\omega)$ and has a higher amplitude. Hence this example corresponds to a nil detected attenuation of the preexisting component between the preceding iteration and the current iteration, the predicted sample $\vec{p}_a(\tau,\omega)$ being in this case representative of the corresponding maintained component. In the third example, the projection component is not in phase opposition with the predicted sample $\vec{p}_a(\tau,\omega)$ and has a lower amplitude. Hence, this example corresponds to a partial attenuation of the preexisting component between the preceding and the current iteration.

Hence, the described detection principle allows detecting a partial or total attenuation of the preexisting component even as the intensity finds itself globally amplified in the frequency band between the preceding iteration and the current iteration.

The attenuation detecting module 300, 301, of the example is adapted for producing the attenuation samples furthermore from data, named damping data, prerecorded in a memory 210 of the detection circuit 137, coupled with the attenuation detecting module 300, 301. The damping data of the example is representative of predetermined factors of the string in free vibration from an observation window to the other. Hence, the attenuation detecting module 300, 301, is adapted for producing attenuation samples 15 particularly representative of the attenuation effect resulting from contacts carried out on the string by the instrumentalist, without suffering from the natural damping effect of the string, attributable to friction in the air, the acoustic resistivity of the instrument . . . . Preferably, the damping data is representative of damping factors specific to different frequency bands, for example a damping value $\beta(\omega)$ specific to each index $\omega$ of the frequency representation.

In practice, the attenuation detecting module 300, 301, of the example comprise a projection sub-module 300, is adapted for producing a digital frequency sample $G(\tau,\omega)$, named amplitude gain sample, representative of an amplitude gain value of the preexisting component between the preceding iteration and the current iteration according to the principle of the following formula:

$$G(\tau,\omega)=\frac{\vec{p}_a(\tau,\omega)\cdot\vec{m}(\tau,\omega)}{\beta(\omega)\vec{p}_a(\tau,\omega)\vec{p}_a^{*}(\tau,\omega)}$$

In this formula, $\beta(\omega)$ designates the free vibration damping factor corresponding to the index $\omega$ of the frequency representation, the · symbol designates the scalar product operator and the symbol * designates the conjugated complex.

Moreover, the attenuation detecting module 300, 301, of the example further comprises a compression sub-module 301 adapted for producing said attenuation samples from the amplitude gain samples by application of a threshold, according to the principle of the following formula:

$$\alpha(\tau,\omega)=\begin{cases}0 & G(\tau,\omega)\le 0\\ 1 & G(\tau,\omega)\ge 1\\ G(\tau,\omega) & 0<G(\tau,\omega)<1\end{cases}$$

In this formula, $\alpha(\tau,\omega)$ designates the detected attenuation sample's value for the frequency band corresponding to the index $\omega$ of the frequency representation.

Given the above, the predicted samples $\vec{p}_a(\tau,\omega)$ and the damping data of the example are representative of a predicted phase value and of a predicted amplitude value for each current measure sample $\vec{m}(\tau,\omega)$. Said phase value and said amplitude value define a predicted waveform for the preexisting component of the current observation window, determined from the waveform of the preexisting component during the preceding observation window. The current measure sample $\vec{m}(\tau,\omega)$ is representative of a real waveform extracted in the corresponding frequency band. In particular, said predicted amplitude value corresponds, in the example, to the amplitude value of the preceding measure sample $\vec{m}(\tau-1,\omega)$ attenuated by the damping factor $\beta(\omega)$ of the corresponding frequency band. Furthermore, said predicted phase value is determined in the example, notably according to a phase variation value detected in the frequency band between a previous iteration, preceding said preceding iteration, and the preceding iteration, and according to a phase value of the preceding frequency sample $\vec{m}(\tau-1,\omega)$ of measurement. In the example, the attenuation samples corresponding to a partial attenuation are each representative of the ratio of a maintained amplitude value detected according to said predicted phase value, on said predicted amplitude value, that is to say extracted according to said predicted phase value.

Given the above, the current measure samples $\vec{m}(\tau,\omega)$ are descriptive of real values according to the invention and the corresponding predicted samples $\vec{p}_a(\tau,\omega)$ are descriptive of prediction values according to the invention, from which the attenuation detecting module 300, 301, carries out a comparison allowing for determining partial attenuation values.

Furthermore, the amplitude gain samples are representative of intensity variation rates, rectified according to the factors $\beta(\omega)$. The amplitude gain samples thus forms a signal of intensity variation rate according to the invention. In the example, the compression sub-module 301 of the attenuation detecting module 300, 301, carries out a compression function of the dynamic range of said signal of intensity variation rate, whose maximum value of compressed dynamic range is equal to 0 decibels.

In addition, in the example, the compressed dynamic range is, below said maximum value, linearly proportional with the dynamic range of the signal of intensity variation rate. Nothing stops one from implementing a compression function having a compressed dynamic range non-linearly proportional with the range of the signal of intensity variation rate. In particular several functions of compression could be predefined for various frequency bands. Also, the device could notably be equipped with input means of at least one parameter of the compression function(s) of the signal of intensity variation rate so as to allow the instrumentalist to adjust the response, in particular the sensitivity, of the attenuation detecting originating from the vibration signal.

The production of attenuation samples according to the example can be object of numerous variants of implementation. In particular, an orthogonal projection of the values 22, 28, 29, of digital frequency samples of prediction error between the preceding iteration and the current iteration can be carried out. In addition, the predicted samples $\vec{p}_a(\tau,\omega)$ can be produced from the damping data so that each predicted sample $\vec{p}_a(\tau,\omega)$ is at the same time representative of said predicted phase value and of said predicted amplitude value. Furthermore, the principle for detecting attenuation by means of projection can be carried out by a time-domain projection, as described later below.

In addition, nothing stops one from carrying out the invention according to simplified prediction models of phase and/or intensity. In particular, the natural damping of the string in free vibration can be left ignored, amplitude gain samples representative of the ratio of the amplitude values of the current measure samples $\vec{m}(\tau,\omega)$ on corresponding predicted amplitudes values can be produced . . . .

In addition, nothing stops one from carrying out an attenuation detecting that is more sophisticated, for example according to an ongoing detected pitch and from damping data specific to different guitar note pitches, representative for each note, of damping values determined for various harmonic ranks of the note.

In addition, nothing stops one from implementing the invention on the basis of more sophisticated model of the vibration of the vibrating body according to the invention. Other techniques for detecting partial attenuations, notably techniques belonging the field of resolution of inverse problems, could be implemented.

In the example, the detection circuit 137 further comprises a calibration module 140, and the synthesizer peripheral 136 is adapted for operating, following a corresponding command transmitted by the central data-processing unit 148, in a mode for calibration of the guitar. In this calibration mode, the attenuation detecting module 300, 301, runs with damping data reinitialized with nil values according to a scale in decibel units. Said calibration module 140 can be adapted for producing the damping data from the resulting attenuation samples, in such way that said damping data then produced is representative, for each index of the frequency representation, of a mean value of attenuation of the string in free vibration into the corresponding frequency band.

In particular, the calibration module 140 can carry out a stationary test method of the digital signal 7 of measurement between two successive observation windows, so as to take into account only those attenuation samples produced when the digital signal of measurement satisfies to minimal stationary criterions. Furthermore, data specific to each index of the frequency representation can be produced according to a minimal intensity threshold of the corresponding frequency component, under which the corresponding attenuation frequency samples are discarded. Preferably, the calibration module 140 can run furthermore from the fundamental signal so that the produced damping data are representative of damping factors of harmonic frequency components of the digital signal 7 of measurement. Such a calibration allows for determining damping data that is precise after execution of various notes down the guitar neck, while leaving the string resonating in free vibration between each note.

Alternatively or in combination, all or part of the damping data can be entered through the means 65 for data entry of the device. In addition, nothing keeps from using damping data predetermined by any means independently of the instrument really linked to the device, in particular data predetermined for a predefined instrument model or a predefined line of instrument models whose acoustic resistivity varies little or not significantly according to the usage conditions (temperature, humidity . . . ) and from one unit to another.

The detection circuit 137 of the example further comprises an excitation detecting module 30 adapted for producing, upon each iteration for each current measure sample $\vec{m}(\tau,\omega)$, a frequency sample, named excitation sample, representative of the added components 19, 22, 23, between the current iteration and the preceding iteration. In particular, each excitation sample can be produced from the current measure sample $\vec{m}(\tau,\omega)$, from the corresponding predicted sample $\vec{p}_a(\tau,\omega)$, from the damping data and from the corresponding attenuation sample of the current iteration. In practice, the excitation detecting module can be implemented according to the principles of the following formula:

$$\vec{e}(\tau,\omega)=\vec{m}(\tau,\omega)-\frac{\alpha(\tau,\omega)}{\beta(\omega)}\vec{p}_a(\tau,\omega)$$

In this formula, $\vec{e}(\tau,\omega)$ represents the excitation sample's value. Preferably, the free vibration damping effect can be taken into account. To this end, the excitation detecting module 30 can be carried out according to the principle of the following formula:

$$\vec{e}(\tau,\omega)=\vec{m}(\tau,\omega)-\alpha(\tau,\omega)\vec{p}_a(\tau,\omega)$$

Nothing keeps from producing the excitation samples $\vec{e}(\tau,\omega)$ according to a more approximate detection method of the added component, for example so that each sample is representative of a perturbation component 22, 28, 29, corresponding to the sum of the added component 19, 22, 23, and a removed component 26, 27.

The detection circuit 137 further comprises a module, named medium-term prediction module 47, for predicting the values of the digital frequency samples of measurement corresponding to an observation window 48 posterior to the current observation window 10. The medium-term prediction module 47 can be implemented the same way than the short-term prediction module 12 so as to produce a predicted sample $$\vec{p}_b\left(\tau+\frac{W}{\Delta},\omega\right)$$

for each frequency sample of measurement of said posterior observation window 48, with the difference that the corresponding preliminary samples $$\vec{P}_b\left(\tau+\frac{W}{\Delta},\omega\right)$$

are produced according to the principle of the following formula:

$$\vec{P}_b\left(\tau+\frac{W}{\Delta},\omega\right)=\vec{m}(\tau,\omega)\cdot\left(\frac{\vec{m}(\tau,\omega)}{\vec{m}(\tau-1,\omega)}\cdot\frac{|\vec{m}(\tau-1,\omega)|}{|\vec{m}(\tau,\omega)|}\right)^{\frac{W}{\Delta}}$$

The detection circuit 137 further comprises a module, named inverse transform module 263, adapted for producing upon each iteration digital samples representative of a waveform 50 predicted for the posterior observation window from corresponding predicted samples $$\vec{p}_b\left(\tau+\frac{W}{\Delta},\omega\right).$$

In practice, an inverse fast Fourier transform can be implemented, with truncation of the last samples—if implementation is done of the traditional zero-padding method—, and then weighting of the resulting sample values with the windowing function and according to an amplitude normalization factor d determined in a traditional fashion in order to compensate for a modification of amplitude attributable to an interleaving of the successive windows, to the weighting by the windowing function and to the fast Fourier transform.

The detection circuit 137 module further comprises a module 264 for constructing a digital signal, named prediction signal 51, adapted for producing, upon each iteration, a digital sample sequence, named predicted sequence 52, of the prediction signal 51, corresponding to the interval of the shift step towards the next observation window 13, named next shift interval 49. The sample values of the digital sample sequences 53, 54, 55, of the predicted waveforms 50, 56, 57, of the current iteration and of the preceding iterations, corresponding to said next shift interval 49 are summed two by two to this end. The digital samples of the predicted waveform 50 of the current iteration are saved in a memory (not represented) of the construction module 264 for following iterations.

The detection circuit 137 of the example further comprises a short lag perturbation detecting module 58 adapted for producing, upon each iteration, a digital sample sequence, named perturbation sequence 59, of a detected perturbation signal $s_\epsilon(n)$. The detection module of the example is adapted for producing said perturbation sequence 59 from the digital sample sequence 60 of the digital signal 7 of measurement held in the interval, named current shift interval 61, of the shift step between the preceding observation window 11 and the current observation window 10, and from the predicted sequence 62 determined during the preceding iteration, in such way that the perturbation sequence 59 is representative of the difference between the waveform of the digital signal 7 of measurement and the waveform of the prediction signal 51 during the current shift interval 61.

The sound preprocessing circuit 141 of the example is adapted for implementing a digital filter so as to produce a filtered digital signal from the sound source samples, the filtered digital signal being representative of the sound waveform after filtering of the sound prerecorded in the selected digital file. The filter of the preprocessing circuit 141 of the example is designed for compensating at least partially, when the synthesizer peripheral 136 is operating in the interactive mode of sound synthesis, a natural imbalance of the relative intensities of the frequency components of the string in favor of the low frequencies with comparison to the high frequencies. For information, the following formula defines the theoretic relative intensity in decibels for different harmonics of a string in free resonance, following an ideal localized pluck giving the string a triangular profile before the beginning of the vibration:

$$P_{dB}(r, \sigma) = 20\log_{10}\left(\frac{|\sin(r\sigma\pi)|}{r^2}\right)$$

In this formula, a represents the ratio of the distance between the top of the triangular profile of the string and the bridge, on the length of the string.

Given the above, the filter of the preprocessing circuit 141 can be designed in such way as to provide an equalization gain of the harmonic frequency components, named prerecorded harmonics, of the prerecorded sound corresponding to the square of the rank of each prerecorded harmonic. Alternatively, nothings stops one from determining the equalization gain values by means of calibration of the frequency response of the string, or else according to a parametric function adjustable by the instrumentalist with the means 65 for data entry. Preferably, the equalization gain values can be limited according to a threshold value of maximum gain predefined so as to prevent the emergence above a tolerable audible threshold, of detrimental sound elements created by a high frequency microphone background noise and/or by a high frequency recording background noise of the selected sound. In practice, this threshold can be adjusted through the means 65 for data entry of the device 3. Alternatively, this threshold can be determined according to measured value of the signal to noise ratio of the hexaphonic pickup and/or measures values of the signal to noise ratio of the selected sound.

In practice, the preprocessing circuit 141 can be adapted for determining the coefficients of a finite response digital filter, named FIR filter, with linear phase, according to a traditional iterative method of digital filter design on the basis of a filter profile defined with the equalization gain values and data, named original pitch data, representative of the fundamental $f_V$ of the selected sound. In practice, the original pitch data can be produced and prerecorded by any mean as metadata in the digital file of the selected prerecorded sound, and transmitted to the synthesizer peripheral 136 with the sound source samples. Alternatively, the original pitch data can be entered through the means 65 for data entry. Alternatively or in combination, the preprocessing circuit 141 can be adapted for implementing a pitch detection method in order to produce said original pitch data from said sound source samples.

Furthermore, the preprocessing circuit 141 of the example is adapted for implementing a sliding window Fourier transform method that conforms with the in-frequency transformation module 8 of the detection circuit 137 so as to produce digital frequency samples, named prerecorded samples (represented by the symbol $\vec{V}$ in FIG. 4), according to a same length of observation window, a same windowing function and a same shift step, from the filtered digital signal whose digital sample values corresponding to a first part 66 are preliminarily reduced to a nil value. Therefore, the prerecorded samples are descriptive of frequency representations of successive segments, named prerecorded segments 69, 70, of a second part 67 of the filtered digital signal, overlapped and shifted according to the shift step.

The original pitch data, the prerecorded samples and a sequence, named initial sequence, of samples of the filtered digital signal corresponding to said first part 66, forms the timbre data transmitted to the synthesis circuit 68 and saved, as previously described, in the memory 139 of the synthesis circuit 68.

The detection circuit 137 of the example is electrically connected to the synthesis circuit 68 so as to transmit on the fly, the fundamental signal, the samples of the perturbation signal, the attenuation samples and the excitation samples produced upon each iteration.

The synthesis circuit 68 of the example comprises several generator modules 142, each of which is adapted for producing for each iteration, modified digital frequency samples, named modified samples, from prerecorded samples corresponding to a prerecorded segment 69, 70. In particular, each generator module 142 is adapted for being capable of producing, for successive iterations, modified samples originating from successive prerecorded segments 69, 70. To this end, the generator sub module 142, can be adapted to increment upon each iteration, an index recorded in a memory space of the memory 139, that is specific to said generator module 142, said index being representative of the current prerecorded segment for the generator module 142.

Each generator module 142 of the example carries out upon each iteration, an in-frequency modification step 158 notably in order to frequency transpose said prerecorded harmonics according to the fundamental signal, and notably to weight the amplitudes of said prerecorded harmonics according to attenuation samples produced for the current iteration. Given the above, each generator module 142 produces during several successive iterations, modified samples corresponding to successive prerecorded segments 69, 70, said modified samples being descriptive of frequency representations of successive segments, named modified segments, of a modified sound that originates from the selected sound.

Said in-frequency modification step 158 comprises notably an interpolation sub-step 143 and a translation sub-step 146, executed for each prerecorded harmonic of the selected sound. These sub-steps carry out a frequency transposition of the prerecorded harmonic towards a harmonic frequency, named transposition frequency 39, 40, 41, complying with the current value of the fundamental signal. Hence, the modified sound is constituted of several components, named frequency contributions, each of which originates from a prerecorded harmonic, and each modulated in frequency as successive iterations take place, according to corresponding transposition frequency values that are successively in force during said successive iterations. The following formula expresses the transposition's frequency shift 71, 72, 73, 74, to be carried out upon each iteration and for each prerecorded harmonic according of a transposition rank in force for that prerecorded harmonic:

$$\delta\omega_\eta(\tau, r) = (\rho_\eta(\tau, r) \cdot f_m(\tau) - r \cdot f_v) \cdot \frac{N}{f_s}$$

In that formula:

$\rho_\eta(\tau,r)$ designates the transposition rank of the prerecorded harmonic of rank r, in force for iteration $\tau$ and for the generator module $\eta$, $\delta\omega_\eta(\tau,r)$ designates said frequency shift of the transposition to be carried out, in terms of frequency samples.

Each generator module 142 is adapted for carrying out an initialization step 154 in the memory 139, of transposition rank data specific to the generator module 142, and representative of transposition rank values in force for each prerecorded harmonic. This step is executed for each iteration corresponding, for that module, to a modification of a first prerecorded segment 69. Preferably, transposition rank data can be initialized so as to transpose, during the in-frequency modification step 158 executed for the first prerecorded segment 69, each prerecorded harmonic towards a harmonic frequency of corresponding rank.

The synthesis circuit 68 of the example further comprises a selection module 75 adapted for extracting from memory 139, for each iteration, an update data set representative of a new value of transposition rank for each value precedingly in force during the preceding iteration. The selection module 75 is adapted for selecting said update data set amongst several update data sets prerecorded in the memory 139 of the synthesis circuit 68.

The graph of FIG. 11 illustrates a principle for producing each update data set. This graph shows oblique lines each corresponding to a transposition rank value in force during preceding iteration, said oblique line representing the corresponding transposition frequency, named preceding frequency, according to the rate (abscissa) of variation of the currently detected fundamental with regard to the preceding iteration. Said preceding frequencies 76, 77, 78, 79, are split amongst intervals 80, 81, 82, of frequency proximity each extending around a frequency 39, 40, 84, that is harmonic with regard to current value of the fundamental signal. This distribution is constant within intervals, named sub-domains 87, 88, 89, of a detection domain 90 of the variation rate.

In the example, an update data set is predetermined for each of said sub-domains 87, 88, 89, so as to define, for several low frequency transposition rank values (four of them in the example of FIG. 11), a new transposition rank value that corresponds to the harmonic frequency 39, 40, 84, of the proximity interval holding the corresponding preceding frequency 76, 77, 78, 79. Hence, each corresponding low frequency contribution is modulated, during the current iteration, towards the closest harmonic frequency according to the logarithmic scale, that is currently is in force. Furthermore, each update data set is predetermined in the example so as to define for each transposition rank value higher than low frequency transposition rank values, a new transposition rank value that is in force according to the principle of the following formula:

$$\rho_\eta(\tau,r)=\rho_\eta(\tau,R_\rho)+r-R_\rho,\ r>R_\rho$$

In this formula $R_\rho$ designates a predefined number of low frequency transposition ranks according to which determine the update data sets.

In the example, the selection module 75 is adapted for producing for each iteration a current sample of a signal representative of the variation rate of the fundamental signal from a current sample and a preceding sample of the fundamental signal. Furthermore, the selection module 75, is adapted for executing itself from threshold data, predetermined by any means and prerecorded in the memory 139 of the synthesis circuit 68 with the update data sets. The threshold data of the example are representative of threshold values, 91, 92, 93, of the variation rate beyond which the preceding frequency 76, 77, 78, 79, of at least one low frequency contribution, shifts from a sub-domain 87, 88, 89, to another. In particular, threshold data and update data sets can be predetermined by any means with regard to the pitch detection domain of the pitch detection module 9 and the desired number of low frequency transposition ranks. The update data sets selected upon each iteration is transmitted to each generator module 142 of the synthesis circuit 68.

Each generator module 142 of the example is furthermore adapted for carrying out an updating step 155 of the transposition rank data. This step is executed from the update data set received during each iteration, named iteration of subsequent modification, corresponding for this module, to a modification of a prerecorded segment 70 posterior to the first prerecorded segment 69. During that step, transposition rank data are saved, after being updated, in the memory 139 for the following iteration.

The following formula illustrates the execution of the updating and initialization steps of transposition rank data, as carried out in the example:

$$\rho_\eta(\tau, r) = \begin{cases} r & \tau = \tau_0(\eta) \\ \Psi(\tau, \rho_\eta(\tau-1, r)) & \tau > \tau_0(\eta) \end{cases}$$

In this formula:

$\Psi(\tau,\rho_\eta(\tau-1,r))$ designates a transposition rank updating value defined by the update data set in force during current iteration, $\rho_\eta(\tau-1,r)$ designates the transposition rank of the prerecorded harmonic of rank r, in force during a preceding iteration $\tau-1$ for the generator module $\eta$, $\tau_0(\eta)$ designates the latest iteration, named triggering iteration, of in-frequency modifications of the first prerecorded segment 69 for the generator module $\eta$.

FIGS. 12 and 13 represents the frequency trajectories of low frequency contributions of a modified sound example produced starting from a triggering iteration 94 of the modified sound and following the subsequent iterations. In these figures, the harmonic frequencies in force for each iteration are represented by circles spaced according to the frequency axis 95 (in Hertz) with regard to the current value 134, 135, of the fundamental signal, said fundamental signal being representative of a pitch 134, 135, played by the instrumentalist on the string according to a playing technique specific to that pitch, for example bringing the string to come up against the fret corresponding to that note. The frequency trajectory of each frequency contribution resulting from that playing is represented by a series of arrows, each extending from a harmonic frequency value corresponding to a transposition frequency in force during the preceding iteration, up to a harmonic frequency value corresponding to the frequency transposition value in force during a current iteration.

FIG. 12 represents an example in which the detected fundamental varies progressively with the result that the variation rate of the detected fundamental is held, upon each iteration, in a sub-domain, named sub-domain 88 of progressive variation, of variation corresponding to the lowest values according to a logarithmic scale of the variation domain in absolute value. Thence, each frequency contribution is modulated according to a same harmonic rank during the iterations. The device of the example is therefore adapted for being capable of producing a sound sequence signal reproducing the timbre of the selected sound in a particularly faithful manner and entirely representative of modulation of the string's pitch by progressive modification of it's tension. It is to be noted that the graph of FIG. 11 and FIGS. 12 and 13 applies to different examples. Indeed, FIG. 11 applies to an example given for four ranks of low frequency harmonics, while FIGS. 12 and 13 applies to examples given for nine ranks of low frequency harmonics. The sub-domain 88 of progressive variation that corresponds to the examples of FIGS. 12 and 13 are therefore narrower in reality than that illustrated in FIG. 11, all things being otherwise equal.

FIG. 13 represents an example in which the detected fundamental varies abruptly with the result that the rate of variation of the fundamental shifts outside of said sub-domain 88 of progressive variation during an iteration 131. Such a variation can be produced notably with a contact of change in pitch carried out by the instrumentalist. In that example, the transposition rank values of the frequency contributions are adjusted during this iteration 131 with regard to the preceding iteration 130. As illustrated in that figure the frequency modulation of the frequency contributions that results is relatively progressive, despite the abrupt variation of the detected fundamental. It results in an improved translation at least for some types contact of change in pitch in terms of realism.

This example is representative of the execution of a B note, named B1, on the low E string of the guitar, named E1, while it is already vibrating according to the low E note, named E1. The corresponding contact of change in pitch leads to a modulation that is hardly perceptible of the frequency contribution whose transposition rank was 3 before said contact. Indeed, the transposition rank of this frequency contribution is 2 after said contact (cf. FIG. 13). This frequency contribution thus forms a channeled component according to the invention. This results in an improved translation of the contact of change in pitch in terms of realism.

The principle illustrated in FIG. 11 can be subject to numerous implementation variants. In particular, a minimization of the frequency modulation can be carried out according to other scales of frequency, in particular a scale taking into account with more accuracy than the logarithmic scale, the sensitivity of the human ear to differences of frequency.

In addition, in a variant of the preferred embodiment of the invention, the detection circuit can be unequipped with the pitch detection module of the example but equipped with a module for detecting the frequency trajectories of vibration, running upon each iteration from the digital samples of measurement provided by the in-frequency transform module 8, so as to implement a detection of local amplitude maximums of the frequency representations and a detection of corresponding frequency trajectories of vibration that associates, from one iteration to the next, a current local maximum to a preceding local maximum as taught by Serra and Smith in the publication *Spectral Modeling Synthesis: A sound Analysis/Synthesis System Based on a Deterministic plus Stochastic Decomposition* (Computer Music Journal, Vol. 14, No. 4, Winter 1990, ©Massachusetts Institute of Technology). In particular, the frequency trajectories of vibration can be initiated or interrupted during each iteration according to the relative spectral positions of the local maximums of the current and preceding iterations. The management of the frequency trajectories of vibration is made according to association criterions, of which notably the distance in frequency between two consecutive local maximums, so that each extracted detected frequency trajectories of vibration corresponds to a partial of the microphone signal that is likely to correspond to a harmonic mode of vibration of the string. In this variant, each ongoing frequency trajectory of vibration is formed by a frequency value extracted upon each iteration, for example according to the phase vocoder technique. Therefore, the execution of sequence of contacts of changes in pitch on a string of the guitar leads to the detection of several concurring frequency trajectories of vibration corresponding to harmonic frequencies of the pitches of the contacts of changes in pitch, namely the pitches actually played by the instrumentalist. In this variant, the frequency contributions are frequency modulated each according to one of the concurring frequency trajectories of vibration, with which the frequency contribution is associated. A frequency trajectory of vibration can correspond to different harmonic ranks from one iteration to another when it is maintained following a contact of change in pitch. As an example, the execution of a transition to a B1 note on the low E string following the E1 note is likely to cause a frequency trajectory of vibration whose harmonic rank is 3 before the corresponding contact and 2 following said contact, to be maintained, the corresponding frequency contribution then forms a channeled component according to the invention. In this variant, frequency trajectories of vibration form a transposition signal according to the invention.

In the interpolation sub-step 143, a bundle of digital frequency samples, named harmonic bundle, is produced from prerecorded samples, named original samples, located in and around the frequency band 96, 97, 98, 99, of the main lobe of the windowing function centered around the prerecorded harmonic's frequency 100, 101, 102, 103, in such way that the samples of said harmonic bundle are representative of interpolated values of frequency samples according to indexes of the frequency representation shifted according to a rounding remainder value of the transposition's frequency shift value 71, 72, 73, 74. Examples of amplitude values (solid lines) of original samples and of corresponding interpolated amplitude values (dotted lines) are represented in FIG. 14. In particular, the interpolation sub-step can be carried out according to a linear interpolation method. This interpolation step allows for partly compensating the approximation error that arises from a transposition shift of an integer number of frequency samples, as it is carried out in the translation sub-step 146 described hereafter. The following formula illustrates the principle of the interpolation sub-step 143:

$$\omega_l(r) = N\frac{r \cdot f_v}{f_s} - \frac{L-1}{2} + l - (\delta\omega_\eta(\tau, r) - \overline{\delta\omega_\eta(\tau, r)})$$

$$l = 0..L-1$$

In this formula:

$\omega_l(r)$ designates the index of the frequency representation corresponding to the sample of index l of the harmonic bundle, L designates a number of digital samples of which each bundle is constituted, this value depending on the width of the windowing function's main lobe, $\overline{\delta\omega_\eta(\tau,r)}$ designates the round value of the transposition's frequency shift in number of frequency samples.

The in-frequency modification step 158 further comprises a weighting sub-step 144 executed for each harmonic bundle produced from the interpolation sub-step 143, in which a bundle of digital frequency samples, named contribution bundle, is produced from the harmonic bundle, phase adjustment data and a bundle, named modulation bundle, of digital samples of complex values.

During each iteration for modifying the first prerecorded segment 69, the generator module 142 is adapted for carrying out, after the initialization step 154 of the transposition rank data and prior to the in-frequency modification step 158, an initialization step 156 of the modulation bundles. In this step, the samples of the modulation bundles corresponding to the various prerecorded harmonics are initialized and saved in the memory 139. In the example, each modulation bundle is initialized from a bundle, named excitation bundle, of current excitation samples located in the frequency band 35, 36, 37, of the main lobe of the windowing function centered around the transposition frequency 39, 40, 41, in force for the prerecorded harmonic given the transposition rank data and the current value of the detected fundamental signal. Preferably, the amplitude values 104, 105, 106, of the samples of each excitation bundle cam be equalized, during the initialization step 156 of the modulation bundles so that the amplitude values of the resulting modulation bundle has a flat frequency profile. To this end, each sample value of the excitation bundle can be weighted with the ratio value given by the maximum amplitude value 104, 106, of the excitation bundle divided by the sample's amplitude value.

During each iteration for modifying a subsequent prerecorded segment 70, the generator module is adapted for executing, following the updating step 155 of the transposition ranks data and prior to the in-frequency modifications step 158, an attenuation step 157. In this step, the modulation bundles saved in memory during the preceding iteration are updated according to attenuation samples produces during the current iteration.

In this respect, the synthesis circuit 68 further comprises an attenuation control module 159 adapted for producing upon each iteration, data, named harmonic attenuation data, from the fundamental signal and the current attenuation samples and providing said harmonic attenuation data to the generator modules 142.

In particular, the harmonic attenuation data of the example comprises low frequency attenuation data representative, for each rank of a predefined number of low frequency ranks (this number being possibly different from the one predefined for producing the update data sets), of the value 32, 33, 34, of the attenuation sample corresponding to the slightest attenuation in the frequency band 35, 36, 37, of the main lobe of the windowing function centered around the corresponding transposition frequency 39, 40, 41 (given the current value of the detected fundamental value).

Furthermore, the harmonic attenuation data of the example comprises high frequency attenuation data, produced from low frequency attenuation data. In particular, the low frequency attenuation data of the example is representative of attenuation factors for high frequency ranks, advantageously corresponding to the mean of the attenuation factors of the low frequency ranks:

$$\gamma(\tau, \rho) = \frac{1}{R_\gamma}\sum_{\chi=1}^{R_\gamma}\gamma(\tau, \chi)$$

$$(p > R_\gamma)$$

In this formula $\gamma(\tau,\rho)$ represents the attenuation factor that applies for prerecorded harmonics corresponding to the transposition rank $\rho$, and $R_\gamma$ designates a predefined number of low frequency transposition ranks ($R_\gamma$ can be different of $R_\rho$).

The samples of the modulation bundles updated during the attenuation step 157 are saved in the memory 139 for the following iteration. The following formula illustrates the attenuation principle of amplitude values of the modulation bundles as carried out in the example:

$$\vec{z}_\eta(\tau,r;l)=\vec{z}_\eta(\tau-1,r;l)\cdot\gamma(\tau,\rho_\eta(\tau,r)),(\tau>\tau_0(\eta))$$

In this formula, $\vec{z}_\eta(\tau,r,l)$ designates the value of the digital sample of index l of the modulation bundle corresponding to the prerecorded harmonic of rank r for the generator module $\eta$.

Furthermore, during each iteration modifying the first prerecorded segment 69, the generator module 142 is adapted for executing, following the initialization step 154 of the transposition rank data and prior to the in-frequency modification step 158, a initialization step 160 of the phase adjustment data. Also, during each iteration modifying a subsequent prerecorded segment 70, the generator module 142 is adapted for executing, following the updating step 155 of the transposition rank data and prior to the in-frequency modification step 158, an updating step 161 of the phase adjustment data.

The phase adjustment data of the example is representative of a complex coefficient that allows for ensuring a phase continuity between the modified samples produced during the current iteration and those produced during the preceding iteration. This data is saved in the memory 139 during each execution of the initialization step 160 or the updating step 161, for the following iteration. The following formula illustrates the initialization and update principles of the complex coefficient for phase adjustment, carried out in the corresponding steps:

$$\vec{\Phi}_\eta(\tau, r) = \begin{cases} e^{\frac{i2\pi\cdot\delta\omega_\eta(\tau,r)\cdot\Delta}{N}} & \tau = \tau_0(\eta) \\ \vec{\Phi}_\eta(\tau-1, r)\cdot e^{\frac{i2\pi\cdot\delta\omega_\eta(\tau,r)\cdot\Delta}{N}} & \tau > \tau_0(\eta) \end{cases}$$

In this formula $\vec{\Phi}_\eta(\tau,r)$ designates the coefficient for phase adjustment.

In the weighting sub-step 144, the digital sample values of the harmonic bundle are multiplied two by two with the sample values of the modulation bundle in force for this iteration so as to modulate the phase and amplitude values of the digital samples of said harmonic bundle. Furthermore the digital sample values of the harmonic bundle are multiplied according to the corresponding complex coefficient for phase adjustment. The following formula illustrates the principle of the weighting sub-step 144:

$$\vec{c}_\eta(\tau,r;l)=\vec{v}_\eta(\tau,r;l)\cdot\vec{z}_\eta(\tau,r;l)\cdot\vec{\Phi}_\eta(\tau,r)$$

In this formula, $\vec{c}_\eta(\tau,r,l)$ designates the contribution bundle's sample of index l of the contribution bundle and $\vec{v}_\eta(\tau,r,l)$ designates the harmonic bundle produced following the interpolation sub-step 143. FIG. 14, represents frequency sample amplitudes 107 of examples of contribution bundle corresponding to the first ranks of prerecorded harmonics.

In the translation sub-step 146, the modified samples, corresponding, in the frequency representation, to frequency indexes shifted according to a rounded transposition shift value 71, 72, 73, 74, with regard to the indexes of the original samples corresponding to the prerecorded harmonic, are produced from the samples of the corresponding contribution bundle. In particular, from one execution of the translation sub-step to the other, sample values of two contribution bundles corresponding to same indexes of the frequency transform are added in the example. In addition, the values of samples of contribution bundles overflowing the Schannon-Nyquist frequency are ignored in the example. Furthermore, the sample values of contribution bundles overflowing towards negative frequencies of the frequency response are folded back to the positive frequencies in the example. Preferably, the modified samples corresponding to the negative frequencies of the frequency representation are produced from the modified samples of the positive frequencies, by hermitian symmetry with the origin. FIG. 14 represents examples of amplitude values 108 of modified samples corresponding to a low frequency part of the frequency representation.

Furthermore, during the attenuation step 157 and during the initialization step 156 of the modulation bundles, data, named data of remaining energy, representative of a value of global energy of remaining amplitude for the samples of the modulation bundles following their initialization or their attenuation, are produced from the corresponding samples, and transmitted to a module, named trigger command module 147, of the synthesis circuit 68. Said trigger command module 147 is adapted for transmitting upon each iteration, starting from the corresponding data of remaining energy transmitted by the generator module 142, a triggering command signal to the generator module 142 corresponding to the smallest value of global energy of remaining amplitude. Each generator module 142 of the example executes furthermore, during each iteration and prior to any other step, an updating step 145 of the index designating the current prerecorded segment. In this step, the index is reinitialized in such way that it designates the first prerecorded segment 69 in the case where the generator module has received the trigger command signal during the preceding iteration, the index being otherwise incremented. Thence, the modified sounds likely to have the strongest sound intensity are maintained from one iteration to the other while a sound likely to have the weakest sound intensity is interrupted upon each iteration in view of freeing a generator module for production of a new modified sound according to the excitation samples of the iteration.

The synthesis module 68 further comprises a superimposition module 162 adapted for mixing the modified frequency samples produced by the generator modules 142 during each iterations, so as to produce samples that are descriptive of a current frequency representation of a digital signal, named tonal synthesis signal 110, in which the frequency contributions of the ongoing modified sounds are superimposed.

The synthesis circuit 68 further comprises an inverse transform module 163 adapted for producing upon each iteration, digital samples representative of a waveform, named tonal waveform 109, from said mixed samples. In practice, a fast method of digital inverse Fourier transform can be used, with truncation of the last samples—if implementation is done of the traditional zero-padding method—, and then weighting with the windowing function and according to said amplitude normalization factor.

The synthesis circuit 68 further comprises a construction module 164 of the tonal synthesis signal 110 adapted for producing for each iteration a sequence of digital samples, named tonal sequence 116, of the tonal synthesis signal, corresponding to the current shift interval 61. The sample values of the digital sample sequences 111, 112, 113, of the current and past tonal waveforms 109, 114, 115, corresponding to this interval 61 are superimposed to this end. The construction module 164 is furthermore adapted for saving the tonal waveform 109 of the current iteration in a memory (not represented) of the construction module 164 for the following iterations.

The synthesis circuit 68 of the example further comprises a convolution module 117 adapted for producing a digital sample sequence, named convolution sequence 118, by means of convolution from the perturbation sequence 59 of the current iteration and the initial sequence of the timbre data. In particular, the convolution can be carried by a traditional fast convolution technique (cf. *The digital signal processing handbook, Vijay Madisetti, Douglas Bennett Williams,* 1998, CRC Press LLC, pp. 8-1 to 8-4). The selection and onset triggering module 117 is furthermore adapted for producing, for each iteration, a digital sample sequence, named onset sequence 122 corresponding to the current shift interval 61, by means of superimposition of the waveforms of the convolution sequences 118, 119, 120, 121, resulting from the latest iterations, shifted each one with regard to the other according to the shift step in conformity with the principle of linear combination of the convolution product. Said onset sequence 122 is representative of a current section of a digital signal, named inharmonic synthesis signal 123.

The detection circuit further comprises an output module 124 adapted for producing the sound sequence signal as the iterations take place. In particular, the detection circuit of the example is adapted for mixing the current onset sample sequence 122 with the current tonal sequence 116 according to respective superimposition gain factors, so as to produce a corresponding sample sequence, named sequence of final synthesis, of the sound sequence signal. In particular, said superimposition gains can be determined by the user from the means 65 for data entry.

The synthesis circuit 68 of the peripherals 136 are electrically connected each to a port of an output circuit 170 of the of the device 3, said output circuit 170 being adapted for producing a digital output signal by mixing the received sound sequence signals, transmitted by the synthesis circuits 68. Preferably, Said output circuit comprises a digital to analog conversion module (not represented) linked to an analog socket 125 installed on the rigid casing 5 so as to allow linking the device to an amplifier 126 equipped with a corresponding analog input socket in view of an audible reproduction of the digital output signal in real time. The output circuit 170 can furthermore comprise an encoding module adapted for translating the digital output signal in any other adequate analog or digital transmission format in view of its provision at a corresponding adapted output socket 127.

In practice, the detection circuit 137, the sound preprocessing circuit 141 and the synthesis circuit 68 of the example can be implemented by means of traditional components of digital electronics, such as programmable logic devices—notably of the FPGA type—, of dedicated digital components—logic gates, latches, application-specific integrated circuit named ASIC—, of read only memories, of flash memories, of microcontrollers . . . . In that case, each module of the detection circuit 137, of the sound preprocessing circuit 141 and the circuit 68 of the example finds itself implemented by hardware. Furthermore, each circuit can be implemented by means of one or several microprocessors, running under a program charged in an associated random access memory, in particular one or several processors specialized in the processing of digital signals. In that case, each module of the circuit is implemented by means a portion of the program code running thanks to the processor(s) so that a corresponding processing step is carried out. The architecture of the synthesis circuit 68 can be notably adapted in accordance with the number of generator modules 142 to be implemented. In this respect, the applicant has noticed through experience that the usage of a reduced number of generator module allows for satisfying sound results in free vibration state. Furthermore, the applicant has noticed through experience the usage of a higher number, but sufficiently modest for a real time implementation, allows for providing sound results representative of the playing of the instrumentalist at all time, including in cases of extended loading of the string (continued rubbing, introduction of forced inharmonic components, noises, etc.).

When a sequence of excitation contacts, comprising notably partial contacts, is executed on a string 2 of the guitar of the example, the excitation samples produced by the detection circuit 137, in the present case extracted from a signal generated by a sensor under the effect of the excitation contacts as the contacts are carried out and as the signal is received, are representative of a detected sequence of excitation contacts carried out on the string, and forms on that ground a sequencing signal according to the invention.

In particular, the excitation samples produced by the detection circuit 137 for one or several observation windows, named excitation contact windows, extending at least partly on a time interval of the digital signal 7 of measurement during which an excitation contact is imparted on the string, are representative of amplitude and phase values of excitation of said excitation contact. In particular, each amplitude value of excitation and each phase value of excitation is detected in the frequency band of the corresponding digital frequency sample of measurement.

In the example, each detected excitation contact leads to the production of modified samples representative of one or several modified sounds, named modified sounds of contact, each triggered following a corresponding excitation contact window, named triggering window. The modified samples of each modified sounds of contact forms an audio signal of contact according to the invention, produced in response to the corresponding excitation contact.

In the example of the preferred embodiment of the invention, the modified samples of each modified sound of contact are produced from the excitation samples of the corresponding triggering window, and sound source samples originating from the selected sound. In particular, each frequency contribution of the modified sound of contact is initially produced by transposing the corresponding prerecorded harmonic around an initial transposition frequency and by weighting the amplitude of the corresponding prerecorded harmonic according to an amplitude value of excitation, named initial gain value, detected in a frequency band holding the initial transposition frequency. Moreover, each frequency contribution is later produced by transposing the corresponding prerecorded harmonic as the following iterations take place, around transposition frequencies successively in force for the frequency contribution during these iterations. During said following iterations, the frequency contribution is produced in addition by weighting the prerecorded harmonic according to said initial gain value attenuated in a cumulative manner according to successive attenuation values, each of which detected in a frequency band of the digital signal 7 of measurement holding the transposition frequency in force during the corresponding iteration.

In particular, each modified sound of contact is attenuated if the occasion arises according to harmonic attenuation data representative of a partial attenuation of the modified sound, produced for one of several observation windows posterior to the triggering window of the modified sound, each extending at least partly on a time interval of the digital signal 7 of measurement during which a detected excitation contact, posterior to the modified sound's contact, is carried out on the string. Said posterior excitation contact then forms a partial contact according to the invention, and said harmonic attenuation data forms partial attenuation of remanence data specific to said partial contact, and constitutes a partial attenuation signal of remanence according to the invention. In addition, the corresponding attenuation samples constitute a raw version of the partial attenuation signal of remanence before processing by the attenuation control module 159. Moreover, nothing stops one from modulating the amplitude of the modified sounds directly from the attenuation samples, without going through the control module 159.

Moreover, given the above, the modified samples of modified sounds of contact corresponding to an excitation contact extending on several observation windows—rubbing of the string for example—combine in such way that the sound sequence signal is representative of a resulting mixed sound representing in a particularly faithful and realistic manner the extended excitation contact. The modulation of the phases of the prerecorded harmonics according to the phase values of excitation detected around the initial transposition frequencies allows indeed for providing a continuity of phase between each modified sound corresponding to a same excitation contact. Furthermore, the attenuation samples allows for carrying out a selection of the modified sound to be interrupted according to the criterion of the smallest value of global energy of remaining amplitude, as carried out by the trigger command module 147, so that only the modified sounds having a timbre corresponding essentially to the starting of the selected sound are ongoing during an extended contact. Thus, the extended contact is translated with a timbre corresponding to the intention of the instrumentalist during all its duration.

Furthermore, the modified sounds triggered in the absence string contact presents an intensity that is proportionate to the non-stationary components they originate from, with the result that their audible impact is negligible for the instrumentalist.

In addition, any partial attenuation effect produced by a partial contact during several observation windows is translated with the starting of the iteration corresponding to the first observation window of said contact.

Furthermore, given the above, the sound sequence signal of the preferred embodiment of the invention shows at all time a harmonic content that varies conformingly to the playing of the instrumentalist without unexpected pitch change effects or sudden tonal distortion effects despite any possible variation of the fundamental signal corresponding to an unexpected pitch change of the detected pitch, in any case with an attenuation of the unexpected pitch change effects or sudden tonal distortion effects.

In the case of a finger impact, named harmonic contact, at the level of a vibration node of a low frequency vibration mode of the string, a variation of the fundamental signal corresponding to an unexpected change of the detected pitch might arise. As an example, the low E string, named E1, of the guitar played open presents, after impact of the finger above the seventh fret starting from the nut of the neck of the guitar, a frequency signature quite similar to the B note, named B2, of the higher octave. A fundamental value corresponding to the B note, named B1, of the lower octave is therefore possibly detected by the pitch detection module 9 of the example. In that case, given the adjustment of the transposition ranks that follows (cf. FIG. 13), each low frequency contribution whose transposition rank is three before the harmonic contact, is in the worst case attenuated and modulated in a negligible way, that is to say in a weakly perceptible fashion, despite such an untimely change of the detected pitch. In consequence, said low frequency contributions are attenuated in a similar fashion in the presence or in the absence of an unexpected change of the detected pitch following the execution of the harmonic contact in the preferred embodiment of the invention.

The applicant has noticed trough experience that the sound sequence signal of the preferred embodiment of the invention represents in a particularly faithful fashion the melodic phrasing carried out on the string including in the presence of extended contacts causing a highly noisy vibration. Furthermore, the sound sequence signal of the device 3 of the example doesn't show sound dissonances, other than that specific to the prerecorded sound if the case arises, in the state of free vibration of the string. In addition, the variation of the amplitude envelope of each prerecorded harmonic is neither accelerated nor slowed by the effect of the transposition as carried out in the example. Thence, the device of the example allows for reproduction of the timbre of the selected sound in a particularly faithful fashion.

The inharmonic synthesis signal 123 of the example is produced by convoluting the perturbation signal $s_\epsilon(n)$ with the first part of the filtered digital signal. Said first part comprising onset transient components of the selected sound, the inharmonic synthesis signal 123 allows for translating with acuteness the percussive effect of each contact produced on the string. In the example, the inharmonic synthesis signal 123 compensates for a dullness of the onset of the modified sounds, resulting from the in-frequency modifications carried out by the generator modules 142, the dullness being all the more important that the observation window is long.

In the example of the preferred embodiment of the invention, the perturbation signal $s_\epsilon(n)$ of the example can be produced with short lag time from the digital signal 7 of measurement, with the result that each contact that is carried out is followed of an audible consequence without perceptible lag for the instrumentalist. Indeed, the shift step can be defined for any string of the guitar so as to correspond to a negligible lag, including for low-pitched strings requiring an observation window of long duration to provide the desired precision of attenuation detecting. The sound preprocessing circuit 141 could be improved in view of extracting in a more precise way the transient components of the selected sound. Any traditional method could be carried out to this end.

The applicant has been able to notice through experience that good results can be obtained for a modest number of low frequency transposition ranks and a modest number of generator modules 142, a real time implementation being hence possible without crippling lag.

Given the above, the short-term prediction module 12 and the attenuation detecting module 300, 301, form, with the associated memory components (cf. FIG. 3), a module for detecting partial attenuations of remanence from a vibration signal according to the invention. Furthermore, the excitation detecting module 30 forms with these modules, a module for detecting a sequence of contacts adapted for being capable of producing a sequencing signal according to the invention.

Furthermore, given the above, the generator modules 142, form a module for triggering signals of contact running with a sequencing signal as input, and adapted for triggering audio signals of contacts as excitation contacts are carried out on a vibrating body. In addition, the generator modules 142 form an amplitude modulating module running with a partial attenuation signal of remanence as input following the execution of a partial contact, and adapted for modulating the amplitude envelope of a remanent audio signal of contact in accordance with at least one partial attenuation value—an attenuating factor in the example—, from a partial attenuation signal of remanence. In addition, the tonal synthesis signal 110 forms a synthesized audio signal according to the invention and the superimposition module 162 forms a module for mixing the audio signals of contacts.

Given the above, the device of the preferred embodiment of the invention carries out, in case of the execution of a sequence of excitation contacts on the string that comprises at least one partial contact, a process for producing sound synthesizer control signals with a view to the production and the sequencing by a synthesizer, of audio signals, named audio signals of contacts, according to a sequence of contacts carried out on a vibrating body, the process comprising:

a step, named input step, for receiving at least one signal, named microphone signal, resulting from a sensor sensing the vibration of the vibrating body under the effect of excitation contacts suitable for bringing the vibrating body into vibration, the microphone signal being representative of said vibration of the vibrating body, a step for producing a sequencing signal for controlling the sequencing of the audio signals of contacts, in which the transients of the microphone signal are extracted from the microphone signal, the sequencing signal being constituted of several extracted transients, a step for producing a signal of detected attenuation of intensity for controlling the attenuation of at least one audio signal of contact, in which the signal of detected attenuation of intensity is extracted from a microphone signal, the signal of attenuation being representative of at least one value of intensity attenuation of the microphone signal, extracted on an interval of the microphone signal extending itself during one of said extracted transients.

In particular, the process for producing sound synthesizer control signals carried out in the example comprises a step for producing a signal of detected tonal frequency for controlling a modulation of the frequency of several frequency components of at least one signal of contact, in which the signal of detected tonal frequency is extracted from a microphone signal, the signal of detected tonal frequency being representative of the frequency of at least one partial of the microphone signal.

In particular, the production step of the signal of detected attenuation of intensity comprises:

a sub-step for producing a signal of intensity variation rate of the vibration signal, extracted from the corresponding vibration signal, a sub-step for compressing the signal of intensity variation rate in which the dynamic range of said signal of intensity variation rate is compressed according to a compressed dynamic range having a maximum value of compressed dynamic range smaller than or essentially equal to 0 decibels.

In particular, in the step for producing the signal of detected attenuation of intensity, said value of intensity attenuation is detected for a frequency component of the corresponding microphone signal.

Given the above, the device of the preferred embodiment of the invention, is adapted for producing a signal of detected attenuation of intensity forming a partial attenuation signal of remanence in the case of the execution of a partial contact. In addition to the partial attenuation value of remanence, the signal of detected attenuation of intensity can be representative of partial attenuation values of muffling corresponding to contacts, named partial choking contacts, causing partial choking of the vibrating body's vibration. In addition, the signal of detected attenuation of intensity can be representative of total attenuation values corresponding to complete choking contacts causing an interruption of the vibrating body's vibration and/or corresponding to excitation contacts that interrupts completely the vibrating body's vibration that is ongoing at the beginning of the excitation contact. In addition, the signal of detected attenuation of intensity can be representative of nil attenuation values corresponding to times of free vibration of the vibrating body and/or to excitation contacts causing no attenuation of the vibrating body's vibration that is ongoing at the beginning of the excitation contact. In consequence, the device of the preferred embodiment of the invention allows for a translation of any effect of partial attenuation of remanence, of partial attenuation of muffling and of complete choking in a way that is both robust and representative of the contacts carried out on the vibrating body.

In the preferred embodiment of the invention, during the execution of a sequence of contacts on the string that comprises partial contacts, the excitation samples are representative of transients of a microphone signal and the attenuation samples form a signal of detected intensity of attenuation.

Nothing stops one from implementing a variant of the preferred embodiment of the invention, unequipped with an excitation detecting module 30 of the preferred embodiment of the invention, and in which the modified samples are produced upon each iteration from a frequency representation of the corresponding perturbation sequence 59 of the perturbation signal produced by the short lag perturbation detecting module 58. In this respect, the sound preprocessing circuit 141 of the example could be adapted for producing prerecorded samples from the filtered signal taken as a whole and not only from the second part 67 of the filtered signal. In particular, a convolution between the perturbation signal and the filtered signal can be carried out with an attenuation, upon each iteration according to attenuation samples produced for that iteration, of the part of the perturbation signal corresponding to past perturbation sequences. Furthermore, generator modules and a trigger command module similar to the ones of the synthesis circuit 67 of the preferred embodiment of the invention can be implemented so as to carry out such a convolution in which are selected upon each iteration the concurring perturbation sequences that are in force for said iteration. Hence, only the perturbation sequences corresponding to significant excitation contacts having not undergone significant attenuation are used for producing the synthesized audio signal of this variant.

Nothing stops one from extracting the transients of a signal representative of the vibration of a vibrating body by means of any other extraction method, for example a method that proceeds with wavelet transformation . . . .

The device of the preferred embodiment of the invention, can be subject of numerous other variants. In particular, each generator module can be adapted for executing a step of selection, amongst several sets of timbre data originating from various digital files of prerecorded sounds, of a set of timbre data from which to produce the modified sound. The selection can be carried out according to predefined criterions, for example according to a scale of the intensity of the excitation such that a more faithful reproduction of the dynamic variation of the timbre of a musical instrument which sound is to be reproduced can be obtained, for example an acoustic piano.

According to another variant of the preferred embodiment, the sound preprocessing circuit can be adapted for producing timbre data further comprising original frequency data for each prerecorded harmonic, representative of a refined value of central frequency of the prerecorded harmonic in frequency. Thence, the original samples from which to produce each frequency contribution can be selected precisely, even for selected sounds having a pronounced inharmonicity. Furthermore, the device of the example can be adapted for taking into account inharmonicity phenomenon of the vibration of the string, such as for example when the string is very strongly plucked, when using string of high diameter . . . . In practice the phase vocoder refinement sub-module of the pitch detection module 9 can be adapted for determining, for each harmonic rank, a value of refined measure of the frequency from a digital frequency sample of measurement corresponding to a local maximum of amplitude located in proximity to a preliminary frequency value of the harmonic rank defined by the preliminary value of the detected fundamental. The following formula represents the frequency shift of the transposition to be carried out in this variant of the preferred embodiment of the invention:

$$\delta\omega_\eta(\tau, r) = \left(\frac{f_m(\tau, \rho_\eta(\tau, r))}{r \cdot f_v(1)} - 1\right) \cdot \frac{N \cdot f_v(r)}{f_s}$$

In this formula:

$f_m(\tau,\rho_\eta(\tau,r))$ designates the value of refined measure of the frequency of transposition of the prerecorded harmonic of rank r, $f_v(r)$ designates the refined value of central frequency of the prerecorded harmonic of rank r.

Furthermore, other synthesis techniques can be carried out alternatively or in combination of the generator modules described for the example of the preferred embodiment of the invention, such as for example additive synthesis techniques, subtractive synthesis techniques, physical modeling synthesis techniques . . . . In this respect, partial attenuation values of remanence can be used as input parameters of a synthesis engine.

Furthermore, the device 3 of the preferred embodiment can be adapted for being able to operate in an alternative interactive mode of sound synthesis in which the attenuation samples are produces independently of the damping data, that is to say without using this data, with a view to using the device 3 with a guitar equipped with a traditional electromagnetic circuit for active sustaining of the vibration of the string in free vibration.

Nothing stops one from applying in the time domain the principle for detecting attenuation carried out in frequency domain by the attenuation detecting module 300, 301. In particular, an amplitude gain sample of a preexisting component can be produced according to the following formula:

$$G(\tau, h) = \frac{s_m(\tau, 1 \ldots \Delta, h) \cdot s_p(\tau, 1 \ldots \Delta, h)}{\beta(h) \sum s_p(\tau, 1 \ldots \Delta, h)^2}$$

In this formula $G(\tau,h)$ represents the amplitude gain sample value produced for a sub band of frequencies of index h during a current iteration $\tau$, $s_m(\tau,1 \ldots \Delta,h)$ represents the waveform of the digital signal 7 of measurement in a shift interval of the current iteration, $s_p(\tau,1 \ldots \Delta,h)$ represents a corresponding predicted waveform, $\beta(h)$ represents a damping factor predetermined for said frequency band and the $\cdot$ symbol designates the scalar product operator. In particular, the principles of prediction described for the medium-term prediction module 47 and the short-term prediction module 12 can be applied for determining the predicted waveform. The attenuation samples $\alpha(\tau,h)$ can be produced from the amplitude gain samples by applying a compression of the dynamic range of these samples, as described for the attenuation detecting module 300, 301. Furthermore, a current sequence of samples of a sub-band excitation signal can be produced according to the following formula:

$$e_h(\tau,1 \ldots \Delta,h)=s_m(\tau,1 \ldots \Delta,h)=\alpha(\tau,h)\cdot s_p(\tau,1 \ldots \Delta,h)$$

Upon each iteration, the frequency contribution of a new modified sound can be produced for each sub-band, each of which by convoluting a current sequence of samples of the corresponding excitation signal with a preprocessed digital signal representative of a frequency component of the selected sound. Each resulting frequency contribution can be attenuated according to a cumulated value of attenuation starting from the iteration following the triggering iteration. Furthermore, a frequency modulation of each frequency contributions can be carried out in time domain by means of multiplication, in conformity with a traditional modulation technique, with an oscillator consisting of an in-phase sinusoidal signal and of a quadrature sinusoidal signal, and whose frequency is adjusted according to the transposition frequency in force upon each iteration for the frequency contribution.

Nothing stops one from applying the principles of the preceding variant's formulas directly from the digital signal 7 of measurement without prior filtering, so that a unique value of damping is produced upon each iteration. In particular, a waveform predicted for a current observation window of the digital signal 7 of measurement can be extracted from a previous observation window shifted with regard to the current observation window according to a value, nominal or detected, of fundamental period of the digital signal 7 of measurement.

In addition, as a variant, the detection circuit 137, the preprocessing circuit 141 and the synthesis circuit 68 can be implemented by means of a unique circuit equipped with a processor running according to a program adapted for carrying out the functionalities of the modules of said circuits, loaded in a random access memory associated with the processor. In particular, the program can be prerecorded in the mass memory 152 and transmitted by the central data-processing unit to the synthesizer peripheral 136 through the corresponding data bus 149, following power-on of the device 3. In practice, said program can be prerecorded in factory into the mass memory 152, or by the user by means of a removable recording medium—for example by means of said socket 63—, by downloading through a communication peripheral (not represented) of the device 3 . . . .

Nothing stops one from carrying out a synthesis device according to the invention comprising a unique processing unit adapted for processing, according to the process of the invention, one or several vibration signals specific to various vibrating bodies of a musical instrument. In particular, the invention can be carried out by means of a generic microcomputer equipped with a microprocessor and an associated random access memory, running according to an operating system loaded in random access memory following power on of the microcomputer, and according to a program loaded in random access memory from a mass memory of the microcomputer, said program being adapted in such way that the microcomputer carries out a process for synthesis of an audio signal according to the invention following the loading of said program, and in such way that at least one vibration signal according to the invention, whose capture is made by a soundcard equipping the microcomputer, is processed by the central unit in view to produce a synthesized audio signal according to the invention at the output of said soundcard.

Nothing stops one from carrying out attenuation detecting by means of an analog filter bank. More generally, all or part of the process of the invention can be carried out by means of analog processing.

In the example, the microphone signal is transmitted at the input of the device 3 by analog transmission means. Nothing stops one from carrying out a device according to the invention processing vibration signal according to the invention received by digital transmission means. In particular, digitizing of each vibration signal can be carried out by a digitizing circuit embedded into the musical instrument. Furthermore, nothing stops one from coupling the digitizing circuit of the musical instrument with an embedded frequency transform circuit so that the vibration signal is provided at the input of a device according to the invention, according to a frequency representation of said signal.

Furthermore nothing stops one from implementing the invention according to a simplified embodiment from a sequencing signal complying with the MIDI standard, extracted according to a traditional onset detection method. Furthermore, nothing stops one from implementing a device according to the invention adapted for allowing production of a synthesized audio signal according to the invention from a sequencing signal according to the invention and a transposition signal according to the invention resulting from a detection circuit adapted for producing those two signals, intervening between the instrument and the device according to the invention.

The device of the preferred embodiment of the invention forms all at once a synthesis device according to the invention and a device for producing synthesizer control signals. In an alternative embodiment, a synthesis device according to the invention can be formed by a device for producing synthesizer control signals and a suitable synthesizer, linked to one another by means of a removable data transmission cable. In this alternative example, the device for producing control signals comprises a detection circuit equivalent to the circuit 137 of the preferred embodiment of the invention, so as to produce attenuation samples and excitation samples from a microphone signal received by means of a socket equivalent to the socket 6 for linking the transmission cable 4 for transmitting the microphone signals in the preferred embodiment of the invention, and to transmit said samples to the synthesizer through a digital output port linked to the removable data transmission cable as synthesizer control signals with a view to control an audio signal synthesis to be executed by the synthesizer, the synthesizer being then allowed to produce sounds taking account of partial attenuations of remanence resulting from partial contacts carried out by the instrumentalist.

Nothing stops one from implementing a device of simplified conception, devoid of a short lag perturbation detecting module 58 and of a convolution module 117. Furthermore, nothing stops one from implementing a process that is conform to the first aspect of the invention and that doesn't implement modulation of the pitch of the synthesized audio signal. In addition, nothing stops one from implementing a device according to the second aspect of the invention with a simplified conception, unequipped with a short lag perturbation detecting module 58 and unequipped with a convolution module 117 and/or unequipped with an attenuation detecting module 300, 301 according to the preferred embodiment of the invention.

The invention claimed is:

1. Process for synthesis of an audio signal, named synthesized audio signal, from a sequencing signal representative of a sequence of contacts carried out on a vibrating body, said sequence comprising excitation contacts suitable for bringing the vibrating body into vibration, process in which:

at least one audio signal, named audio signal of contact, is produced for each of said excitation contacts, a signal, named partial attenuation signal of remanence, is produced from a signal, named vibration signal, representative of the vibration of the vibrating body generated by at least one excitation contact, named partial contact, the partial attenuation signal of remanence being representative, for said partial contact, of at least one partial attenuation value of remanence of at least one audio signal of contact, named remanent audio signal of contact, resulting from an excitation contact that is previous to said partial contact, the synthesized audio signal after said partial contact is produced by mixing the audio signal of contact of said partial contact and each remanent audio signal of contact affected by the partial attenuation signal of remanence.

2. Process as claimed in claim 1, wherein the sequencing signal is representative of a detected sequence of contacts carried out on the vibrating body by an instrumentalist.

3. Process as claimed in claim 1, wherein the sequencing signal is produced from a signal, named source signal for excitation detecting, representative of the vibration of the vibrating body, as the reception of the source signal for excitation detecting takes place.

4. Process as claimed in claim 1, wherein said partial attenuation value of remanence is determined from values of said vibration signal belonging to a time interval, named detection interval of attenuation of remanence, during which said partial contact is carried out on the vibrating body.

5. Process as claimed in claim 1, wherein said partial attenuation value of remanence is determined by comparing between:

at least one value, named real value, extracted from the vibration signal on a first time interval of the vibration signal, and at least one value, named prediction value, determined from:

at least one second value extracted from the vibration signal on a second time interval of the vibration signal, that is previous to the first time interval, and according to a predetermined prediction model of the variation in time of the vibration signal between the first and the second time interval.

6. Process as claimed in claim 1, wherein the process comprises:

a step for extracting a signal of intensity variation rate of the vibration signal, executed from the vibration signal, a step for producing a partial attenuation signal of remanence from the signal of intensity variation rate, in which the dynamic range of said signal of intensity variation rate is compressed according to a compressed dynamic range having a maximum value of compressed dynamic range smaller than or essentially equal to 0 decibels.

7. Process as claimed in claim 1, wherein said partial attenuation value of remanence is detected for a frequency component of the vibration signal.

8. Process as claimed in claim 1, wherein the partial attenuation signal of remanence is representative of several partial attenuation values of remanence of a selfsame remanent audio signal of contact, detected for different frequency components of the vibration signal.

9. Process according to claim 1, wherein:

the partial attenuation signal of remanence is representative of several partial attenuation values of remanence of a selfsame remanent audio signal of contact, detected for different frequency components of the vibration signal, the remanent audio signal of contact has several frequency components, each affected by at least one partial attenuation value of remanence specific to an associated frequency component of the vibration signal.

10. Process as claimed in claim 1, wherein:

the synthesized audio signal is in addition produced from a signal, named transposition signal, resulting from a sequence of contacts of changes in pitch of the vibrating body's vibration carried out on the vibrating body, the transposition signal being representative, for each contact of change in pitch, of at least one harmonic frequency corresponding to a pitch resulting from the contact of change in pitch, so that several frequency components, named modulated components, of at least one audio signal of contact are each modulated successively around harmonic frequencies, named synthesis frequencies, each specific to a harmonic rank of a pitch of the sequence of contacts of changes in pitch, for at least one partial contact, named partial contact of change in pitch, causing a change in pitch towards a new pitch, at least one modulated component, named channeled component, of a corresponding remanent audio signal of contact, named harmonized remanent audio signal of contact, is modulated around a harmonic frequency, named new synthesis frequency, of the new pitch, corresponding to a harmonic rank different from the harmonic rank of a preceding synthesis frequency of the channeled component.

11. Process as claimed in claim 1, wherein:

the synthesized audio signal is in addition produced from a signal, named transposition signal, resulting from a sequence of contacts of changes in pitch of the vibrating body's vibration carried out on the vibrating body, the transposition signal being representative, for each contact of change in pitch, of at least one harmonic frequency corresponding to a pitch resulting from the contact of change in pitch, so that several frequency components, named modulated components, of at least one audio signal of contact are each modulated successively around harmonic frequencies, named synthesis frequencies, each specific to a harmonic rank of a pitch of the sequence of contacts of changes in pitch, for at least one partial contact, named partial contact of change in pitch, causing a change in pitch towards a new pitch, at least one modulated component, named channeled component, of a corresponding remanent audio signal of contact, named harmonized remanent audio signal of contact, is modulated around a harmonic frequency, named new synthesis frequency, of the new pitch, corresponding to a harmonic rank different from the harmonic rank of a preceding synthesis frequency of the channeled component, the partial attenuation signal of remanence is representative of several partial attenuation values of remanence of a selfsame remanent audio signal of contact, detected for different frequency components of the vibration signal held in different frequency bands of the vibration signal, the channeled component is attenuated according to at least one partial attenuation value of remanence of the partial attenuation signal of remanence, detected for a frequency component whose frequency band holds the new synthesis frequency of the channeled component.

12. Process as claimed in claim 1, wherein at least one frequency component, named high component, of a remanent audio signal of contact, is attenuated according to an attenuation value, determined from several partial attenuation values of remanence specific to frequency components, named low components, of the remanent audio signal of contact held in low frequency bands with respect to a frequency band holding said high component.

13. Synthesis device comprising at least one processing unit adapted for:

synthesizing an audio signal, named synthesized audio signal, from a sequencing signal representative of a sequence of contacts carried out on a vibrating body, said sequence comprising excitation contacts suitable for bringing the vibrating body into vibration, producing at least one audio signal, named audio signal of contact, for each of said excitation contacts, being capable of producing a signal, named partial attenuation signal of remanence, from a signal, named vibration signal, representative of the vibration of the vibrating body generated by at least one excitation contact, named partial contact, the partial attenuation signal of remanence being representative, for said partial contact, of at least one partial attenuation value of remanence of at least one audio signal of contact, named remanent audio signal of contact, resulting from an excitation contact that is previous to said partial contact, producing, after any partial contact, the synthesized audio signal by mixing the audio signal of contact of said partial contact and each corresponding remanent audio signal of contact affected by the partial attenuation signal of remanence.

14. Device as claimed in claim 13, wherein it comprises means for detecting a sequence of contacts carried out on the vibrating body by an instrumentalist, and wherein the processing unit is adapted for being capable of producing the sequencing signal from a sequence of contacts carried out on a vibrating body by an instrumentalist, detected by said means for detecting.

15. Device as claimed in claim 13, wherein the processing unit is adapted for being capable of producing the sequencing signal from a signal, named source signal for excitation detecting, representative of the vibration of the vibrating body, as the reception of the source signal for excitation detecting takes place.

16. Recording medium adapted for being capable of being read in a reader of a data-processing device, and on which is recorded a computer program adapted for being capable of being loaded in a random-access memory of said data-processing device when the recording medium is loaded in said reader, wherein the computer program comprises portions of program code for the execution, when the computer program is loaded into the random-access memory of the data-processing device, of the steps of a process for synthesis of an audio signal, named synthesized audio signal, from a sequencing signal representative of a sequence of contacts carried out on a vibrating body, said sequence comprising excitation contacts suitable for bringing the vibrating body into vibration, process in which:

at least one audio signal, named audio signal of contact, is produced for each of said excitation contacts, a signal, named partial attenuation signal of remanence, is produced from a signal, named vibration signal, representative of the vibration of the vibrating body generated by at least one excitation contact, named partial contact, the partial attenuation signal of remanence being representative, for said partial contact, of at least one partial attenuation value of remanence of at least one audio signal of contact, named remanent audio signal of contact, resulting from an excitation contact that is previous to said partial contact, the synthesized audio signal after said partial contact is produced by mixing the audio signal of contact of said partial contact and each remanent audio signal of contact affected by the partial attenuation signal of remanence.

17. Computer program comprising portions of program code for the execution, when said program is executed on a data-processing device, of the steps of a process for synthesis of an audio signal, named synthesized audio signal, from a sequencing signal representative of a sequence of contacts carried out on a vibrating body, said sequence comprising excitation contacts suitable for bringing the vibrating body into vibration, process in which:

at least one audio signal, named audio signal of contact, is produced for each of said excitation contacts, a signal, named partial attenuation signal of remanence, is produced from a signal, named vibration signal, representative of the vibration of the vibrating body generated by at least one excitation contact, named partial contact, the partial attenuation signal of remanence being representative, for said partial contact, of at least one partial attenuation value of remanence of at least one audio signal of contact, named remanent audio signal of contact, resulting from an excitation contact that is previous to said partial contact, the synthesized audio signal after said partial contact is produced by mixing the audio signal of contact of said partial contact and each remanent audio signal of contact affected by the partial attenuation signal of remanence.

* * * * *